US011124341B2

(12) United States Patent
Patton

(10) Patent No.: US 11,124,341 B2
(45) Date of Patent: Sep. 21, 2021

(54) PLASTIC BOTTLE RETAINING APPARATUS AND ADVERTISING PLATFORM

(71) Applicant: Tommy L. Patton, Oak Glen, CA (US)

(72) Inventor: Tommy L. Patton, Oak Glen, CA (US)

( * ) Notice: Subject to any disclaimer, the term of this patent is extended or adjusted under 35 U.S.C. 154(b) by 82 days.

(21) Appl. No.: 15/788,180

(22) Filed: Oct. 19, 2017

(65) Prior Publication Data

US 2019/0119019 A1 Apr. 25, 2019

(51) Int. Cl.
*B65D 71/50* (2006.01)
*G09F 23/00* (2006.01)

(52) U.S. Cl.
CPC ..... *B65D 71/504* (2013.01); *G09F 23/00* (2013.01); *B65D 2203/00* (2013.01); *B65D 2203/06* (2013.01); *B65D 2203/10* (2013.01)

(58) Field of Classification Search
CPC ... A45F 5/10; A45F 2200/0583; B65D 71/50; B65D 71/504; B65D 71/42; B65D 71/44; Y10S 206/82; G09F 3/04
USPC ..... 206/150
See application file for complete search history.

(56) References Cited

U.S. PATENT DOCUMENTS 2,419,040 A 4/1947 Stephanian
3,003,805 A 10/1961 Glazer
3,461,643 A * 8/1969 Strand ..... A61J 7/02 53/471
3,633,962 A 1/1972 Erickson
4,022,363 A 5/1977 Eliassen
4,232,807 A 11/1980 Beier et al.
4,651,873 A 3/1987 Stolcenberg et al.
4,735,313 A 4/1988 Schoenberg
4,798,286 A 1/1989 Muscanelli
4,941,624 A * 7/1990 Schuster ..... B65D 71/36 206/140
5,018,620 A * 5/1991 Marco ..... B65D 71/504 206/150
5,267,427 A 12/1993 Peterson et al.
5,306,060 A 4/1994 Borg
5,346,271 A * 9/1994 Erickson ..... B65D 67/02 206/151
5,501,322 A 3/1996 Drebushenko
5,551,566 A * 9/1996 Sutherland ..... B65D 71/40 206/427
5,735,562 A 4/1998 Borg
6,129,397 A 10/2000 Borg
(Continued)

*Primary Examiner* — King M Chu
(74) *Attorney, Agent, or Firm* — Patent Law Inc

(57) ABSTRACT

A plastic bottle retaining apparatus and advertising platform (BRAAP) that is used to captively hold at least one, and preferably multiple, plastic beverage bottles and includes advertising or promotional indicia printed thereon. The BRAAP has a structure which is a strip, or a panel. The strip and panel can be resilient and disposable, and each have at least one, and typically multiple, openings that are each dimensioned to allow a bottle's neck to be inserted and maintained within, or removed from, the opening. When a bottle is inserted into an opening, the BRAAP with the retained bottle, can be packaged, stored, transported or displayed. When a bottle is pulled from an opening, the bottle neck is released, thereby allowing the bottle to be removed from the BRAAP. The advertising or promotional indicia includes a company name, a coupon, a sport team name, event information, commercial offers, entertainment information, or social media information.

27 Claims, 23 Drawing Sheets

(56) References Cited

U.S. PATENT DOCUMENTS

| | | | | |
|---|---|---|---|---|
| 7,823,943 | B2 | 11/2010 | Borg | |
| 2002/0175103 | A1 | 11/2002 | Kraxner | |
| 2010/0163445 | A1 | 7/2010 | Egher | |
| 2015/0191287 | A1 * | 7/2015 | L'Heureux ..... | B65D 71/44<br>206/152 |

* cited by examiner

PLASTIC BOTTLE RETAINING APPARATUS AND ADVERTISING PLATFORM

TECHNICAL FIELD

The invention generally pertains to bottle holding and carrying devices, and more particularly to a plastic bottle retaining apparatus and advertising platform (BRAAP) that allows multiple plastic beverage bottles to be quickly and easily inserted into or removed from a folded or unfolded strip for storage, packaging or transportation, and that provides a platform for multiple types of advertising.

BACKGROUND ART

Throughout the world, the most widely used method of selling and purchasing a fluid product is a plastic or glass bottle. Glass is typically utilized for certain fluids, such as those that are corrosive or would otherwise damage a plastic bottle. For beverages such as water, soft drinks or sport drinks, plastic bottles are the preferred method. In the United States alone it is estimated that fifty billion bottles of water and soft drinks are sold annually.

Although plastic and glass beverages bottles are practical and convenient, there are associated problems. The most prevalent problems are that it is often expensive and difficult to manufacture packaging and to transport bottles, and it takes an extended time for a plastic or glass bottle to biodegrade. So, most of the bottles that are thrown away and placed into landfills will remain there for a long time. Considering the sheer number of bottles that are being used, the available space required into which disposed bottles are placed is quickly running out. Also, multiple full beverage bottles typically require additional space and the bottles have significant weight, both of which contribute to difficulties in packaging, transportation and display in a retail environment.

Additionally, the production of plastic bottles relies heavily on the use of natural gas, industrial manufacturing devices, chemicals, fossil fuels and manpower, as well as the requirement of additional packaging materials such as plastic wrap and cardboard.

In an effort to solve these problems, certain cities now require the segregating of plastic or glass bottles (as well as other materials) when disposed. Plastic bottles are each manufactured and filled with a particular fluid, by specialized means. Once a bottle is filled and sealed with a cap, dedicated packaging is used for each type of bottle and fluid therein. It is typically not possible to use single manufacturing and packaging methods for both filled plastic bottles and filled glass bottles.

What is needed is an apparatus that would facilitate the quick and easy retaining of plastic bottles. Optimally, there will be a way of placing the bottles on a clean, secure strip that only requires minimum of space. Full bottles could be packaged and stored in a limited area, and then when the full bottles are displayed for sale, this could be accomplished with minimal effort. Packaging, transportation and display could be accomplished in less time since it would be easier to weigh or count bottles individually when on a strip.

The addition of various types of advertising or promotional indicia would add a lucrative commercial aspect and would be an enticement to use the BRAAP. Additionally, a single strip that could be used for both plastic or glass bottles would be extremely beneficial. Including a strip within a package of bottles is a convenient and efficient method of providing the BRASP to consumers. Utilizing a strip as an actual packaging component for bottles would provide drink producers a cost saving and highly effective alternative to current packaging methods.

A search of the prior art did not disclose any literature or patents that read directly on the claims of the instant invention. However, the following U.S. patents are considered related:

| PAT. NO. | INVENTOR | ISSUED |
|---|---|---|
| 4,022,363 | Eliassen | May 10, 1977 |
| 4,651,873 | Stolcenberg, et al | Jan. 17, 1989 |
| 5,267,427 | Peterson et al | Dec. 7, 1993 |
| 5,501,322 | Drebushenko | Mar. 26, 1996 |
| 2010/0163445 | Egber | Jul. 1, 2010 |

The U.S. Pat. No. 4,022,363 discloses a device for carrying and storing bottles. The device has a older frame utilizing a series of parallel rails inside the frame. The rails form between them uniform gaps and the edges of the rails have edge portions which yield upon introduction of a bottle neck and then squeeze the neck into a locking arrangement when the bottle is moved in a direction perpendicular to the plane defined by the holder.

The U.S. Pat. No. 4,651,873 discloses a beverage container holder having a unitary body with apertures therein adapted to receive containers. A handle is also included for easy hand carrying.

The U.S. Pat. No. 5,267,427 discloses a recycling strip for holding, storing, toting and returning recyclable plastic bottles. The strip has a plurality of collar holes distributed uniformly and unilinearly along the strip. The collar holes have a diameter slightly larger than the outside diameter of a common plastic bottle neck and have radial slits forming collars which enable a bottleneck flange to be engaged in the strip. The strip is used for transporting engaged bottles and can be recycled with the bottles. The strip is loaded into a dispenser which provides means of storing the strip. The dispenser also holds the strip securely so that a bottle may be engaged in the strip. The dispenser also provides an engagement mechanism, which aligns a collar hole in the strip with the collar opening of the dispenser and prevents the strip from uncontrolled travel out of the dispenser and a disengagement mechanism which meters the travel of the strip.

The U.S. Pat. No. 5,501,322 discloses a carrier and storage unit for beverage bottles. A planar member has a plurality of cup-shaped recesses located in a predetermined array across its surface. Each of the recesses has a bottom wall which is sealed about its periphery to the circular wall of the recess. The recesses have a size and configuration adapted to receive and grip the neck of the beverage bottles, capturing the beverage bottle in secure retention in the carrier and closing the neck of the bottle.

The 2010/0163445 publication discloses a bottle holder having a first bottle-holding surface adapted to hold a plurality of bottles at a first orientation, and a second bottle-holding surface adapted to hold a second plurality of bottles at a second orientation. Each bottle-holding surface includes an aperture adapted to receive a cap end of each bottle, and a slot in communication with the aperture and adapted to support a bottle neck of each of the bottles.

For background purposes and indicative of the art to which the invention relates, reference may be made to the following remaining patents found in the patent search.

| PAT. NO. | INVENTOR | ISSUED |
|---|---|---|
| 2,419,040 | Stephanian | Apr. 15, 1947 |
| 3,003,805 | Glazer | Oct. 10, 1961 |
| 3,633,962 | Erickson | Jan. 11, 1972 |
| 4,232,807 | Beier, et al | Nov. 11, 1980 |
| 4,735,313 | Schoenberg | Apr. 5, 1988 |
| 4,798,286 | Muscanelli | Jan. 17, 1989 |
| 5,306,060 | Borg | Apr. 26, 1994 |
| 5,735,562 | Borg | Apr. 7, 1998 |
| 6,129,397 | Borg | Oct. 10, 2000 |
| 7,823,943 | Borg | Nov. 2, 2010 |
| 2002/0175103 | Kraxner | Nov. 28, 2002 |

DISCLOSURE OF THE INVENTION

In its basic design, the plastic bottle retaining apparatus and advertising platform (BRAAP) is comprised of a structure, typically a strip or panel, having advertising or promotional indicia applied thereon and at least one, and preferable multiple openings. The panel or strip can be made of plastic, metal, wood, a composite, or a biodegradable material. The panel or strip can also be disposable and resilient. The BRAAP is used to captively hold at least one, and typically a plurality, of plastic beverage bottles, such as those used for water, soft drinks or sports drinks. Each of the openings on the panel or strip is dimensioned to allow a bottle's neck to be inserted and maintained within the opening, or removed from the opening. When bottles are inserted into the openings, the BRAAP with the retained bottles can be easily stored or transported. When an inserted bottle is pulled from the opening, the bottle neck is released, thereby allowing the bottle to be removed from the panel or strip.

In order to provide optimal use of the BRAAP and to maximize space, bottles can be inserted into and attached to a panel or strip from the top or bottom. The openings can accept bottles with larger than typical neck diameters by use of slits and tabs that radially extend inward and outward from the edges of each opening, and the tabs interface with threads on a bottle neck to provide assisted insertion of the bottle neck as the bottle neck is twisted into an opening. The slits and tabs allow the material adjacent the opening to flex, thereby enlarging the opening. The panel or strip can be any size or shape to accommodate any number of bottles. The design of the panel and strip creates a BRAAP that is lightweight and easy to manage by a single person, even with multiple bottles. Examples of the type of advertising or promotional indicia that can be applied are: a company name, a coupon, a sport team name, event information, commercial offers, amusement/theme park information, school information, entertainment information or social media information.

Optimally, the BRAAP is utilized to facilitate advertising and promotion, as well as the retaining of plastic beverage bottles by making it quick and easy to package, store, count and ultimately transport bottles from a beverage manufacture to a wholesale or retail facility. Also, a strip or panel can be placed on a lower surface of a package of multiple bottles, with an end section of the strip or panel extending from each end of the packaged bottles. The strip or panel, along with the packaged bottles can then be lifted together and hand carried or transported.

In view of the above disclosure, the primary object of the invention is to provide a plastic bottle retaining system that allows multiple plastic beverage bottles to be quickly and easily inserted into or removed from a strip or panel for storage, transportation or display, and as a platform for advertising or promotional information to be disseminated.

In addition to the primary object, it is also an object of the invention to provide a plastic bottle retaining system that:

- can include any type of advertising or promotion information,
- can be used for a variety of plastic beverage bottles,
- can be used by adults and children, young and old,
- is durable and long-lasting,
- can be recycled along with plastic bottles,
- encourages recycling by removing some of the obstacles and concerns,
- can be easily cleaned and re-used,
- is easy to manufacture,
- can be used in conjunction with a proprietary recycling machine,
- is cost effective from both a manufacturer's and consumer's point of view.

These and other objects and advantages of the present invention will become apparent from the subsequent detailed description of the preferred embodiment and the appended claims taken in conjunction with the accompanying drawings.

BEST MODE FOR CARRYING OUT THE INVENTION

The best mode for carrying out the invention is presented in terms that disclose multiple embodiments with various design configurations of a plastic bottle retaining apparatus and advertising platform (BRAAP) 10.

Throughout the world, plastic bottles are the most ubiquitous and widely used articles in the transporting, displaying/selling and consumer use of beverages, such as water, soft drinks and sports drinks. Although plastic beverage bottles are usually recyclable, the number of bottles that are actually recycled is relatively low compared to the number that are used. This is a serious problem because of the sheer number of plastic bottles that are simply thrown away and end up in landfills. This problem is exacerbated by the fact that it takes 450-1000 years for a plastic bottle to biodegrade. Also, there is a considerable investment of finances and manpower required to package, transport and display full bottles of beverages.

The BRAAP 10, as shown in FIGS. 1-21, provides a solution to almost all of the problems and/or concerns related to retaining plastic beverage bottles. The BRAAP 10 allows a person to quickly and easily acquire and store any number of plastic beverage bottles and at the same time be exposed to and utilize advertising or promotional information or have an opportunity to become aware of commercial or non-commercial information on offers. The BRAAP 10 is simple to use; has no moving parts; is economical, both for a manufacturer and consumer/end-users; is clean, is adaptable to space/storage requirements, and can be used as an effective means of disseminating commercial or non-commercial information.

All of the embodiments and design configurations of the BRAAP 10 include an advertising platform which comprises both advertising and promotional indicia that is located directly on a strip 22 or panel 14, as shown in FIGS. 3, 5, 6, 7, 8, 11 and 12. Examples include a company name, a coupon, a sport team name, event information, amusement/theme park information, school information, commercial offers, entertainment information, or social media information. There are various ways of applying the advertising or promotional indicia 64, including printing, etching, molding (either during manufacture or after manufacture), attaching an outward extending feature, screen printing, adhesion, or other similar methods.

Figure 4:
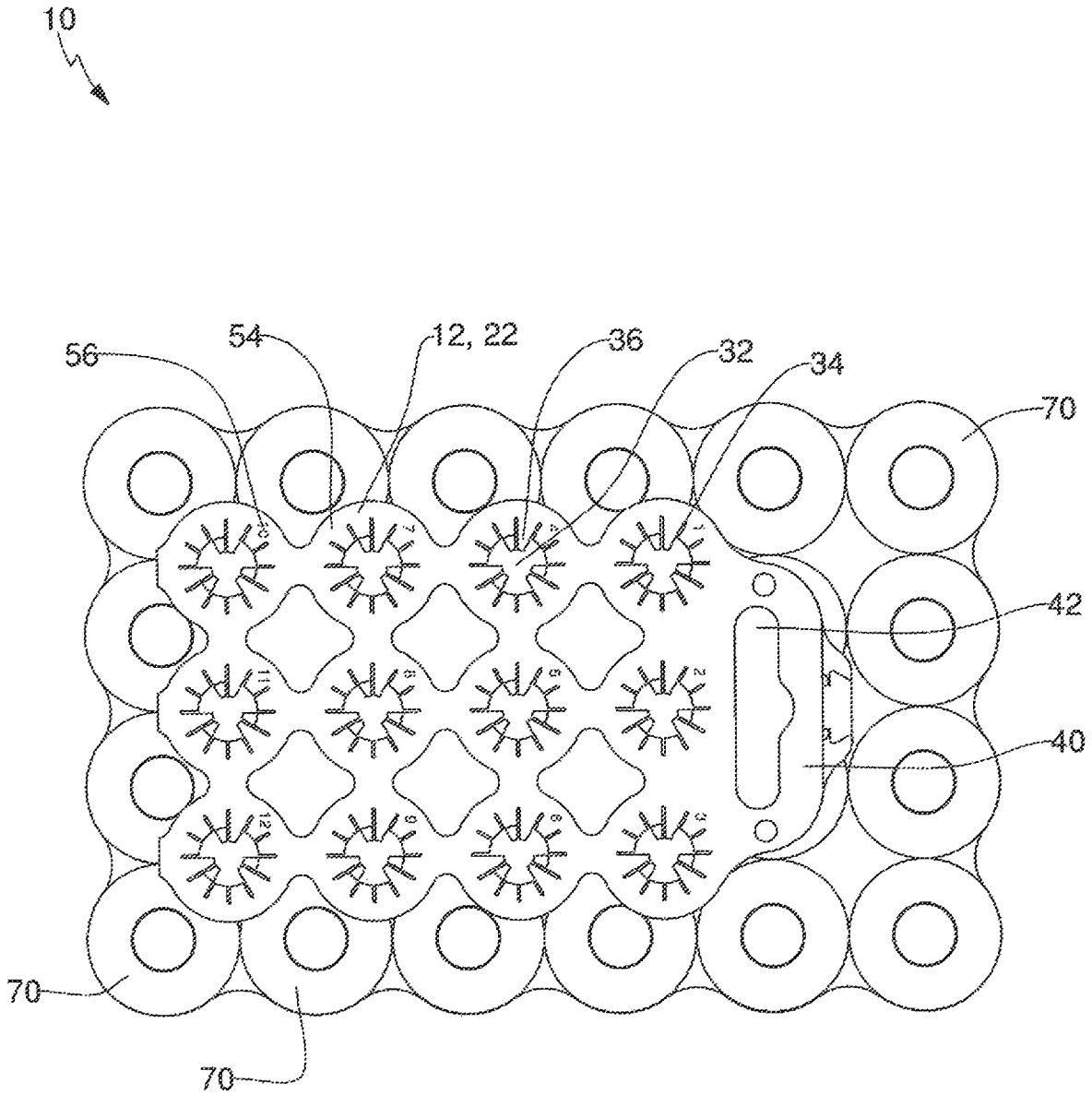
FIG. 4 is a plan view of a folded BRAAP placed on top of a package of multiple plastic bottles.
Figure 5:
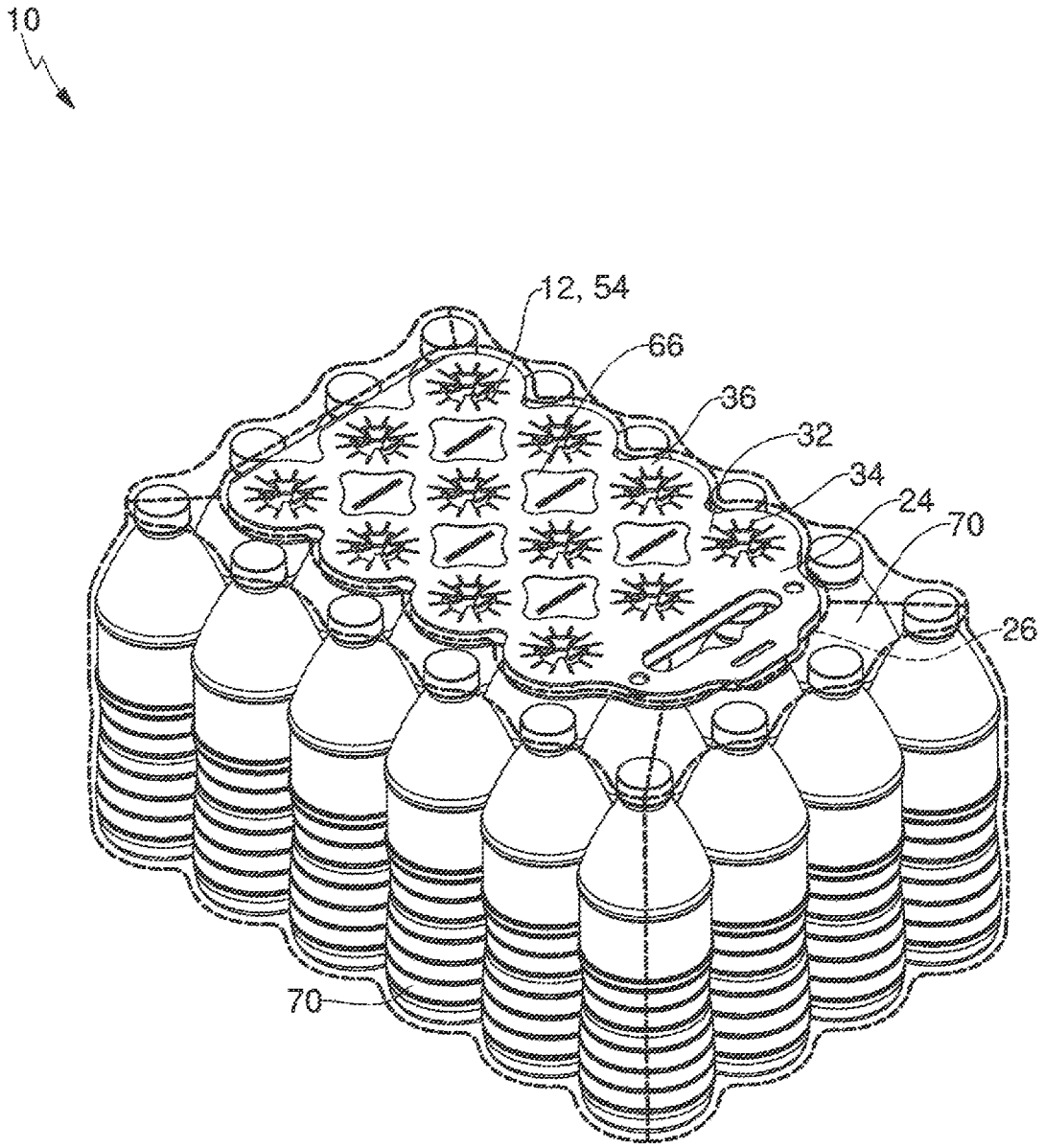
FIG. 5 is an orthography top view of the BRAAP and placed within a package of multiple plastic bottles.
Figure 6:
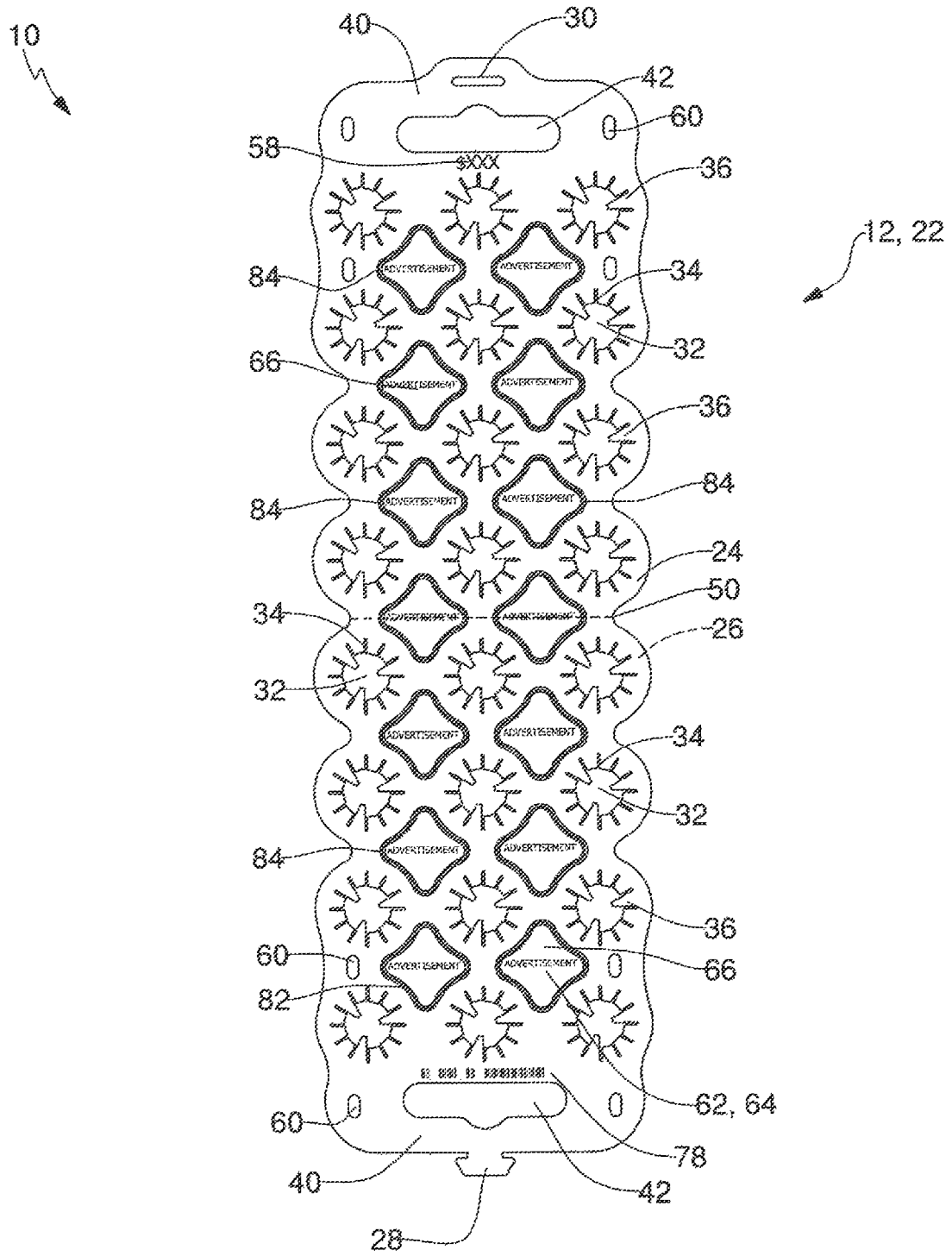
FIG. 6 is a top plan view of the BRAAP in a triple strip configuration.
Figure 7:
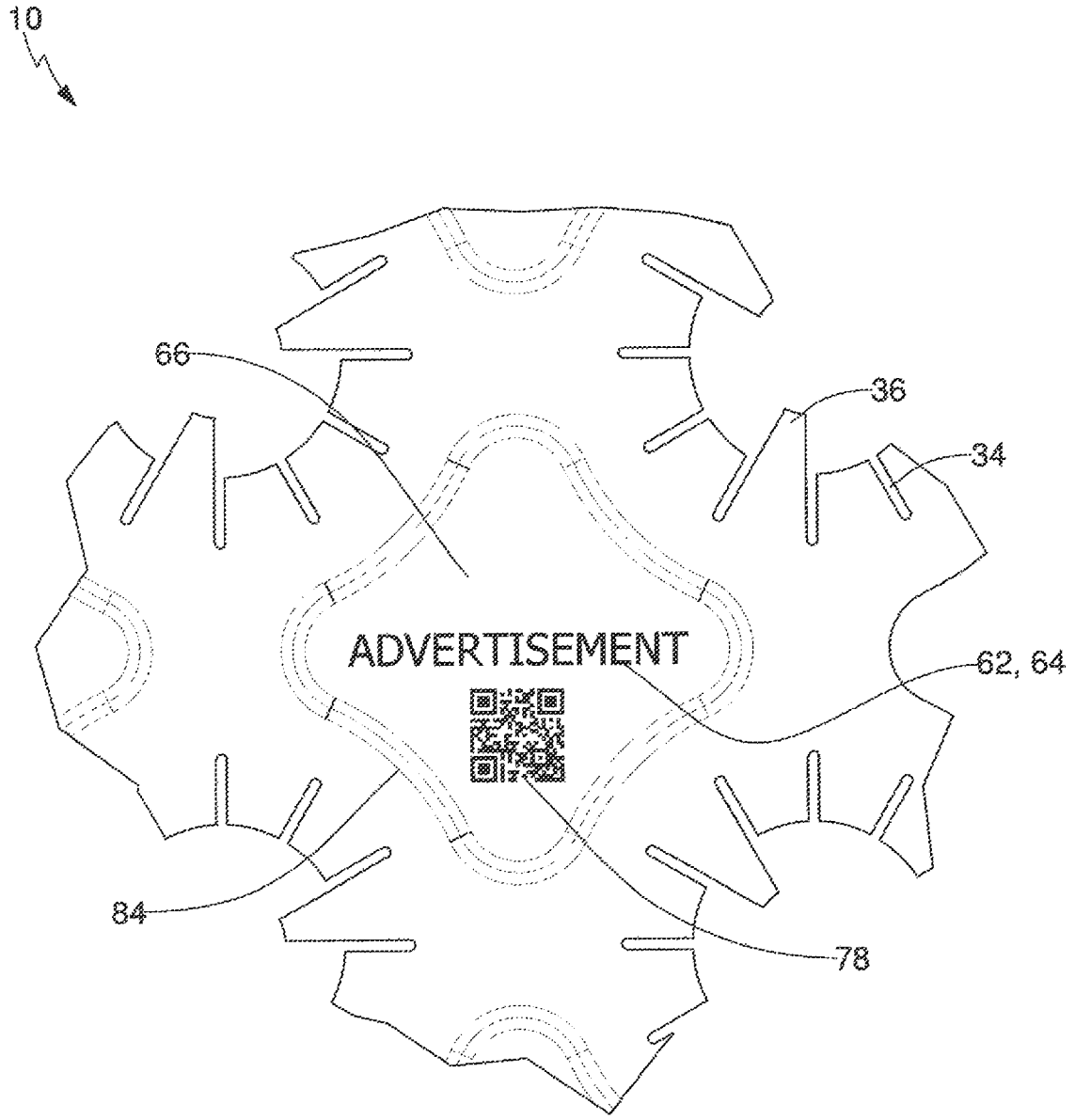
FIG. 7 is a detail view of one of the BRAAP's advertising cavities.
Figure 8:
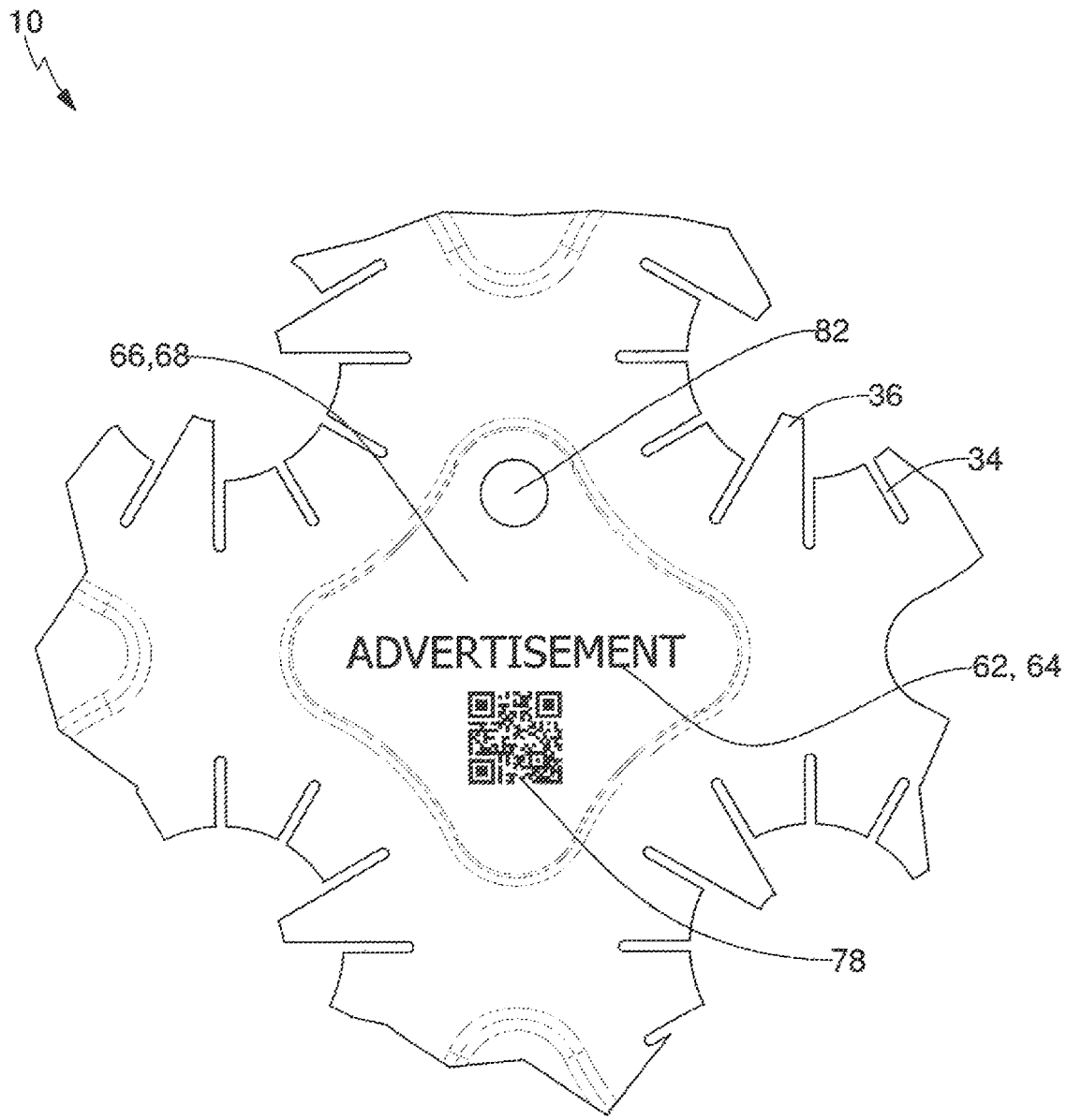
FIG. 8 is a detail view of one of the BRAAP's advertising punch-outs with a pull-tab.
Figure 9:
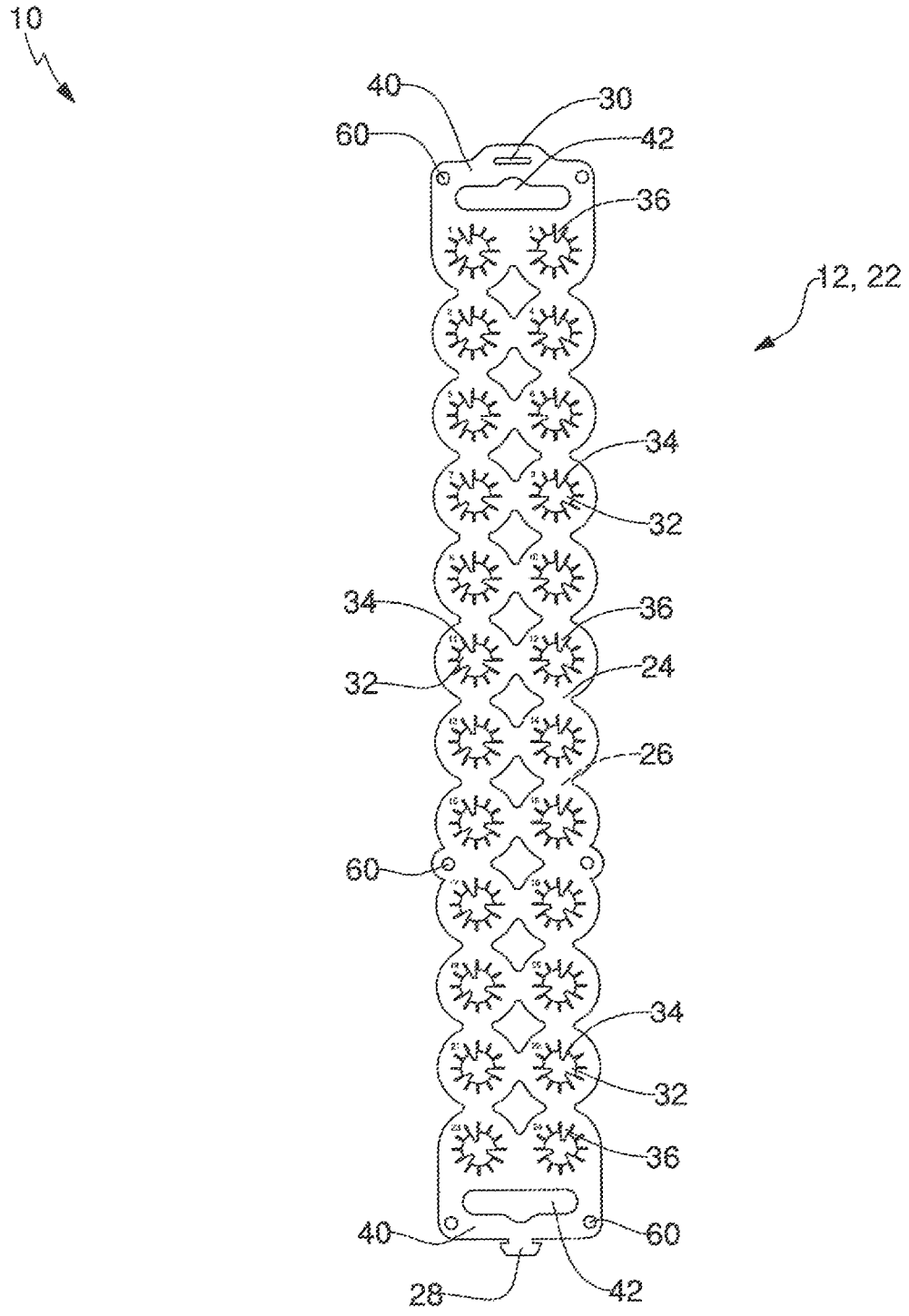
FIG. 9 is a top plan view of the BRAAP in a double trip configuration.

To add to the functionality of the advertising platform 62, in addition to placing the indicia 64 directly on the surface on a strip 22 or panel 14, at least one cavity 66, as shown in FIGS. 3-7 and 11-13, and/or at least one punch-out 68, as shown in FIG. 8, can be utilized. To add structural strength to the area surrounding a cavity 66 or punch-out 68, a peripheral reinforcement 84, as shown in FIGS. 6 and 7, can be located around each cavity or punch-out. The indicia 64 is placed within the confines of the cavity 66, which is preferably molded into the structure 12 during manufacture. The indicia 64 is also placed within the confines of the punch-out 68. A benefit of the punch-out 68 is that a person can quickly and easily remove the punch-out 68 from the strip 22 or panel 14. To facilitate the extraction of a punch-out 68 by hand, a pull-tab 82, as shown in FIG. 8, can extend from each cavity or punch-out. This allows removable/redeemable advertising or promotional indicia 64 such as a coupon to be utilized. It should be noted that the inclusion of the advertising or promotional indicia greatly extends the utility of the strip 22 or panel 14.

Figure 16:
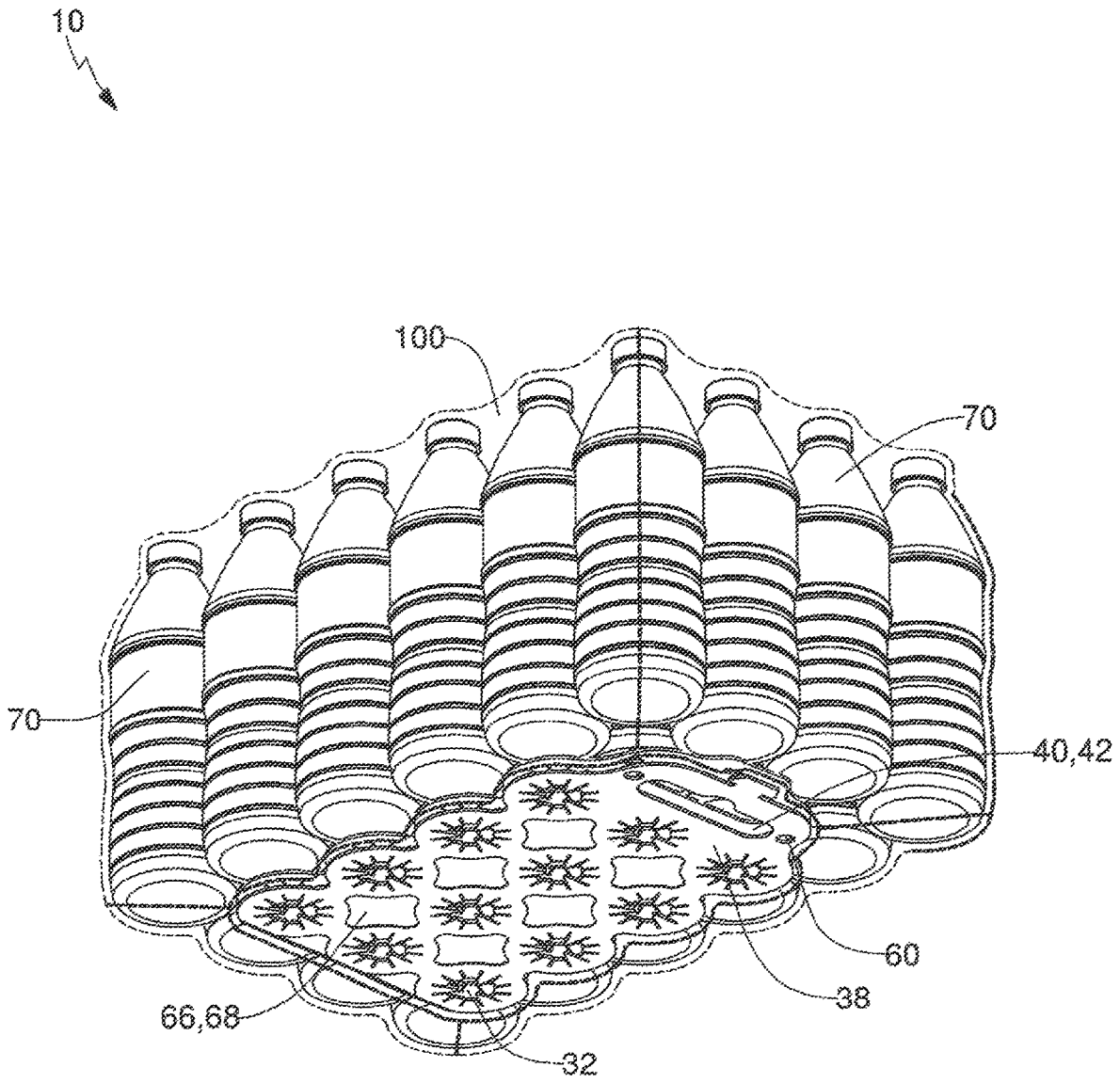
FIG. 16 is an orthographic bottom view of a folded strip placed on the lower surfaces of multiple bottles, with the bottles and strip enclosed within packaging.
Figure 20:
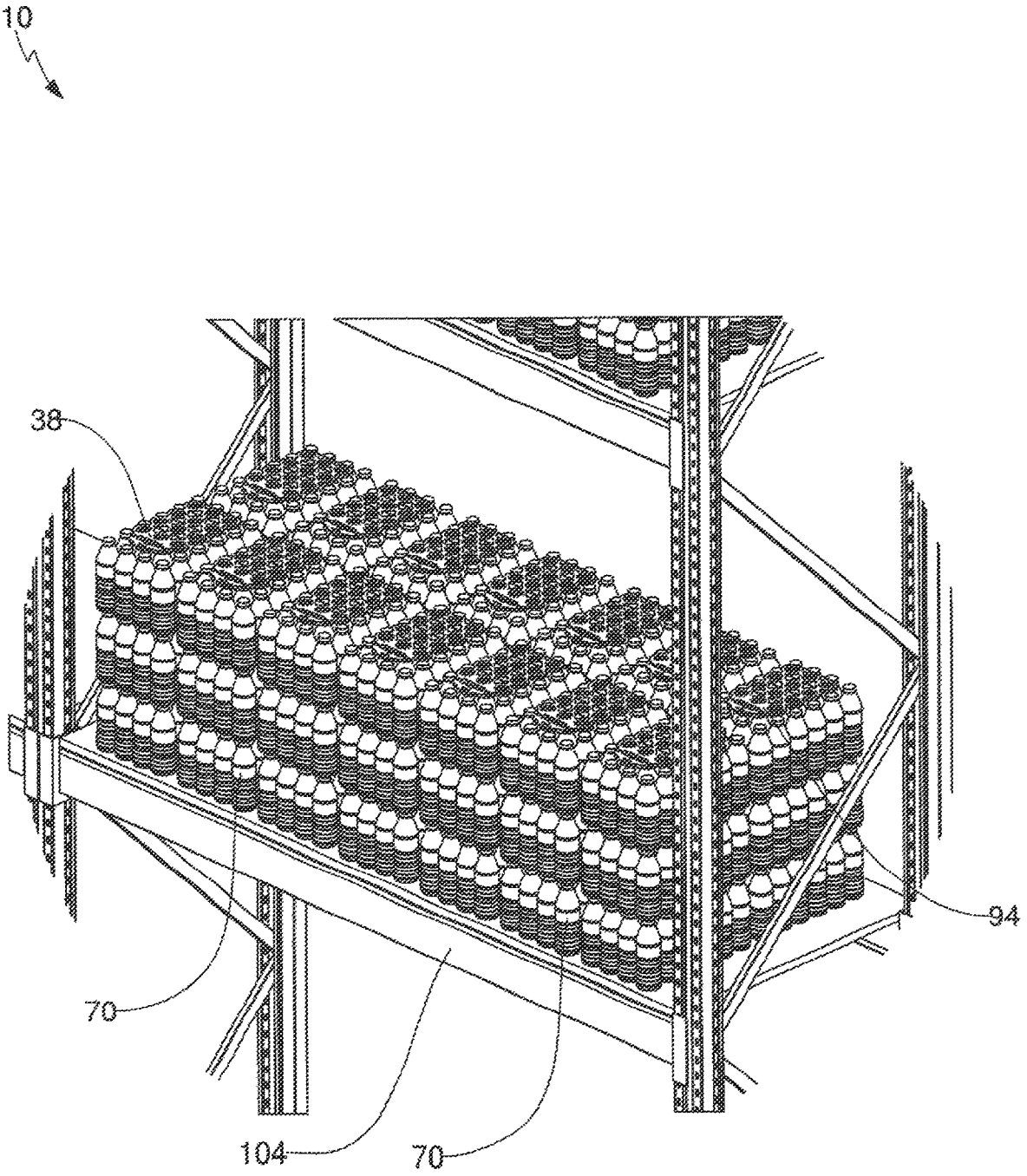
FIG. 20 is an orthographic view of a strip utilized as an actual packaging component of multiple full bottles.
Figure 21:
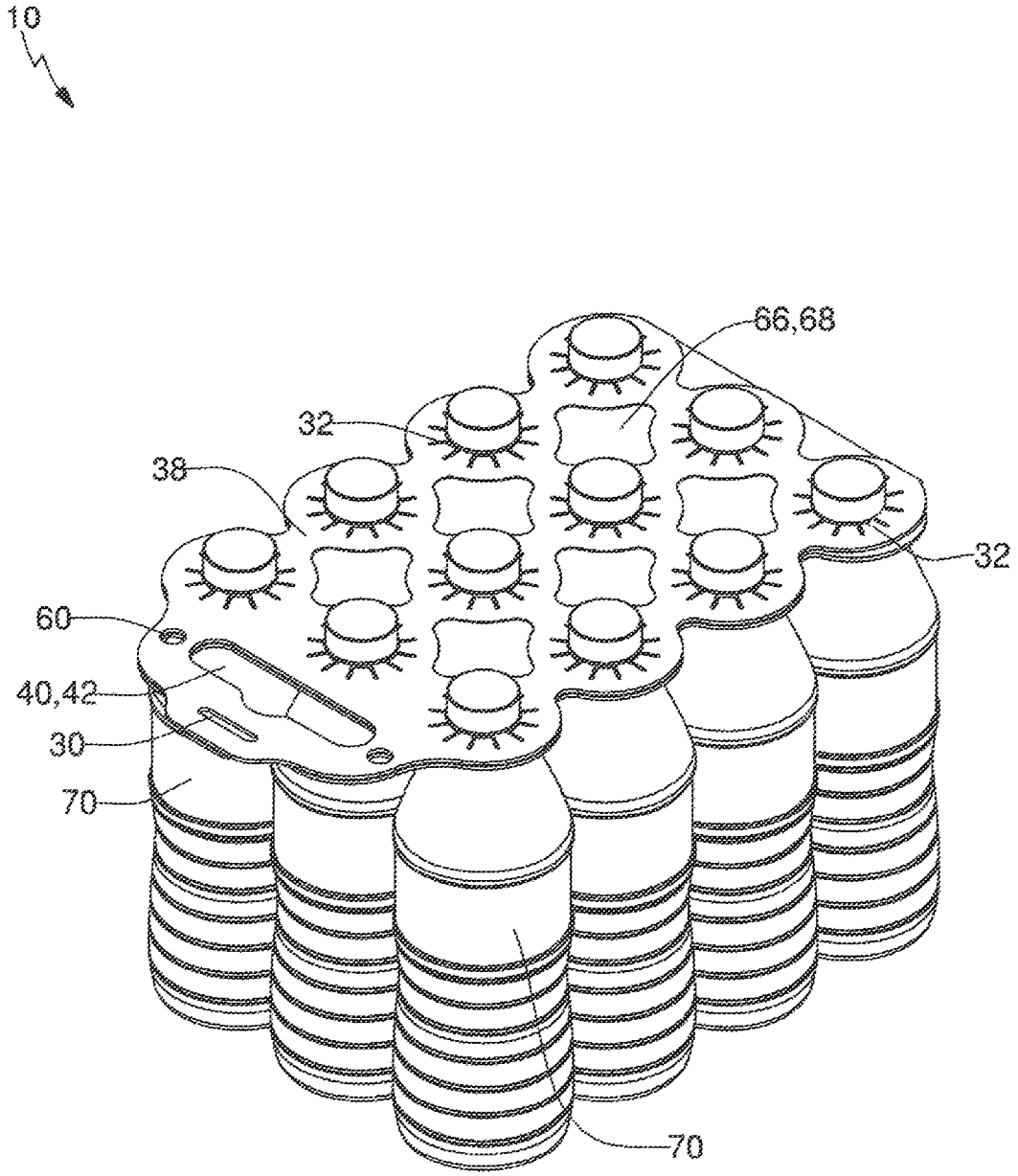
FIG. 21 is an orthographic front vie w of multiple full bottles attached to a strip that is the packaging component, and multiple groups of strip—packaged bottles placed on a shelf for storage or retail display.

To allow said strip 22 to be maintained on a separate structure, at least one securing means 60, as shown in FIGS. 3, 6, 9, 10, 11, 13 and 14, is utilized. The securing means 60 is preferably comprised of a slot, but can also be comprised of a circular or other shaped opening, and the securing means is located either on one side of the handle opening 42, or preferably two securing means 60 are utilized with one on each side of the handle opening 42. Additionally, depending on the application or requirement, the securing means 60 can be located anywhere on the strip, such as adjacent a side edge. The strip can also be included within wholesale or retail packaging 100, as shown in FIG. 16, or even as an actual packaging component, as shown in FIG. 20. When used as the packaging component, multiple groups of strip—packaged bottles can be easily and effectively stored or displayed, such as on a shelf 104, as shown in FIG. 21.

Figure 3:
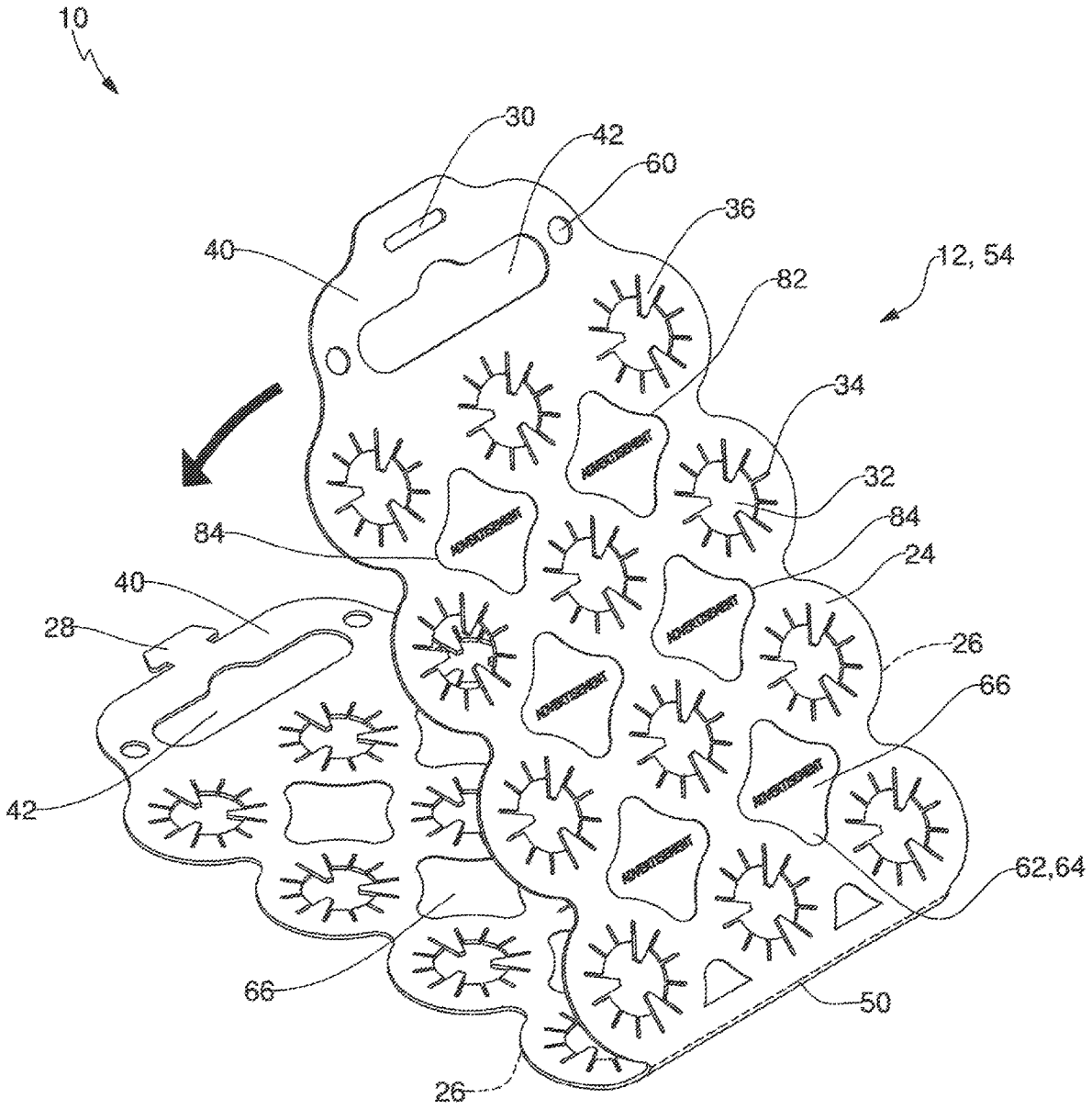
FIG. 3 is an orthographic view of the BRAAP in a mid-folded position.
Figure 11:
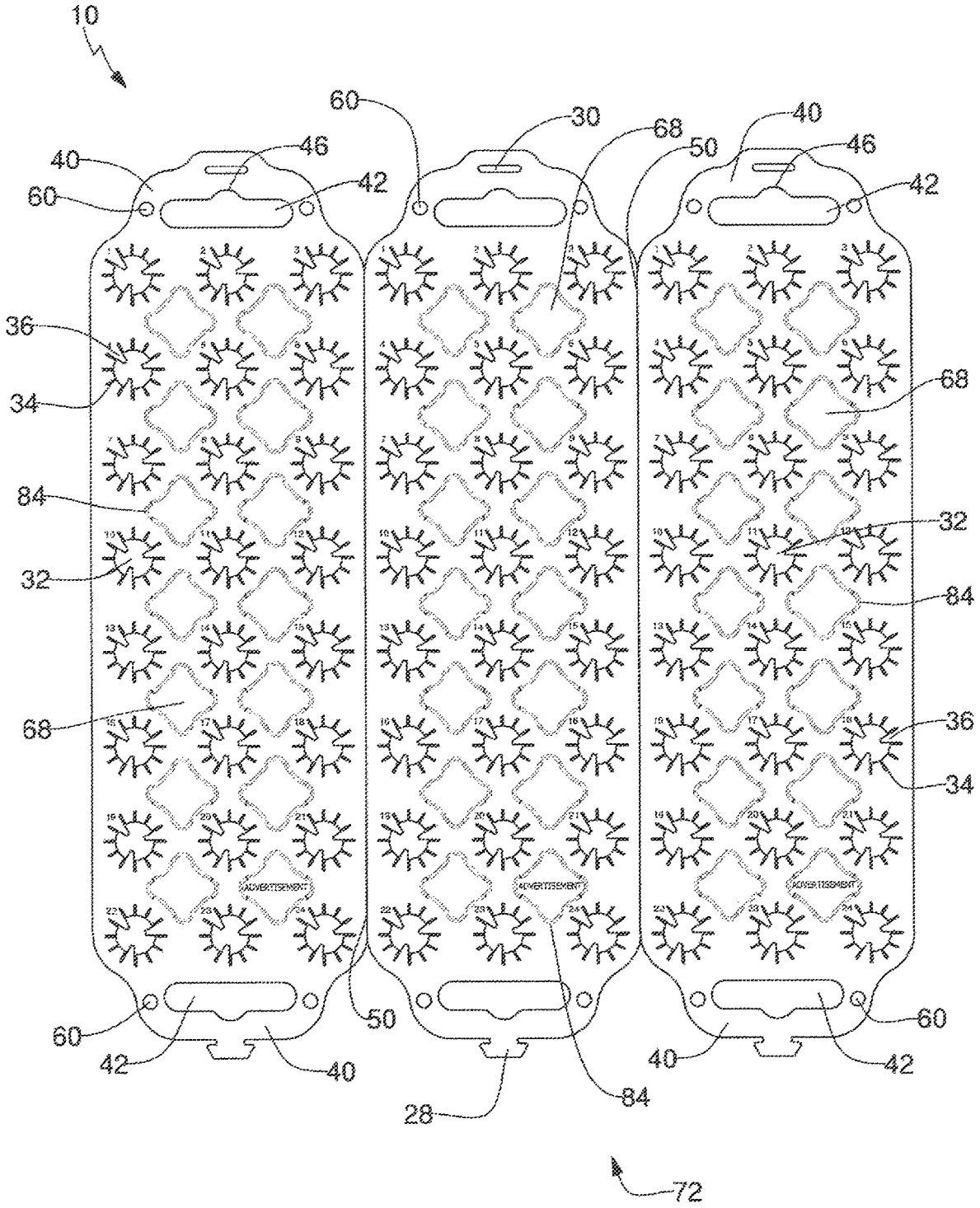
FIG. 11 is a top plan view showing structure of multiple strips attached together with a score mark separating each strip, thereby allowing each strip to be individually removed from the structure.

One embodiment of the BRAAP 10 is comprised of a structure 12 that is used to captively hold plastic beverage bottles 70. The structure 12 can be used for a single bottle 70, but optimally a plurality of bottles are held on a structure 12. A first design configuration of the BRAAP 10 uses a structure 12 comprised of a panel 14, which can be made in any geometric shape, with square or rectangular preferred, as shown in FIGS. 3, 6, and 11. The actual shape and size of the panel 14 is typically determined by the requirements of use. For example, a single-person household wherein a limited number of plastic bottle are used would not require the same size panel as a restaurant that quickly collects many plastic bottles. Optimally, the BRAAP 10 will be available in a variety of shapes and sizes to fulfill the requirements of various applications/uses. The panel 14 has an upper surface and a lower surface, and can be made of a variety of materials including plastic, metal, wood, a composite, or a biodegradable material. Preferably, the panel 14 is made of a lightweight, flexible material that does not require maintenance and can be easily cleaned when necessary. It is envisioned that in one design the panel will be made of recyclable plastic and the BRAAP 10 will be recycled along with the plastic bottles 70.

A second preferred embodiment of the BRAAP 10 uses a structure 12 comprised of a strip 22, as shown in FIGS. 9, 10, 12 and 17. The strip 22 can be any length or width, again depending on the requirements of the application or the desire of the user. As with the panel 14, the strip 22 can be made of a variety of materials including plastic, metal, wood, a composite or a biodegradable material. The strip 22 which is preferably resilient and can also be made of a flexible material such as rubber, has an upper surface 24 and a lower surface 26.

Figure 1:
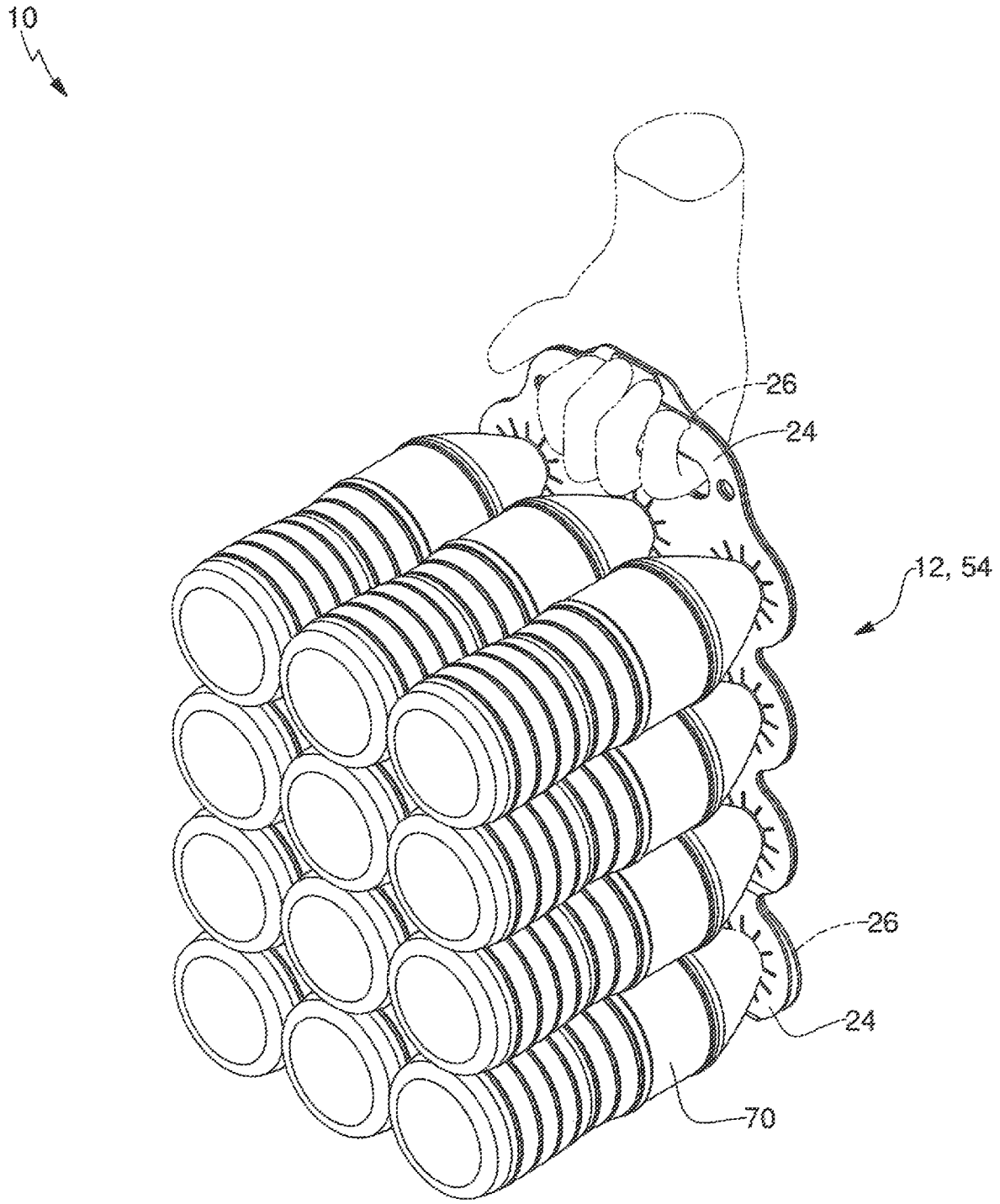
FIG. 1 is an orthographic view of a plastic bottle retaining apparatus and advertising platform (BRAAP) showing a folded, doubled structure retaining twelve bottles and being carried by one hand through a handle opening.

Although the preferred embodiment is comprised of a strip (or alternately a panel), the optimal use of the BRAAP 10 has the strip 22 or panel 14 folded at the substantial lateral midline, as shown in FIGS. 1, 3, 4 and 5, either with a score mark 50, or without a score mark, thereby doubling the thickness of the strip. The folded strip 38 or panel 54 configuration preferably has two handles 40 with one handle located at each end. Each handle comprises an opening 42, and when the strip is folded 38, the two handles openings 42 are doubled and aligned, thereby allowing the folded strip 38 with full bottles inserted to be grasped through the handles openings and carried by hand, as shown in FIG. 1. The folded strip 38 or panel 54 is particularly effective for use carrying full bottles, and for use a packaging component as previously disclosed and shown in FIG. 20 and FIG. 21.

Figure 14:
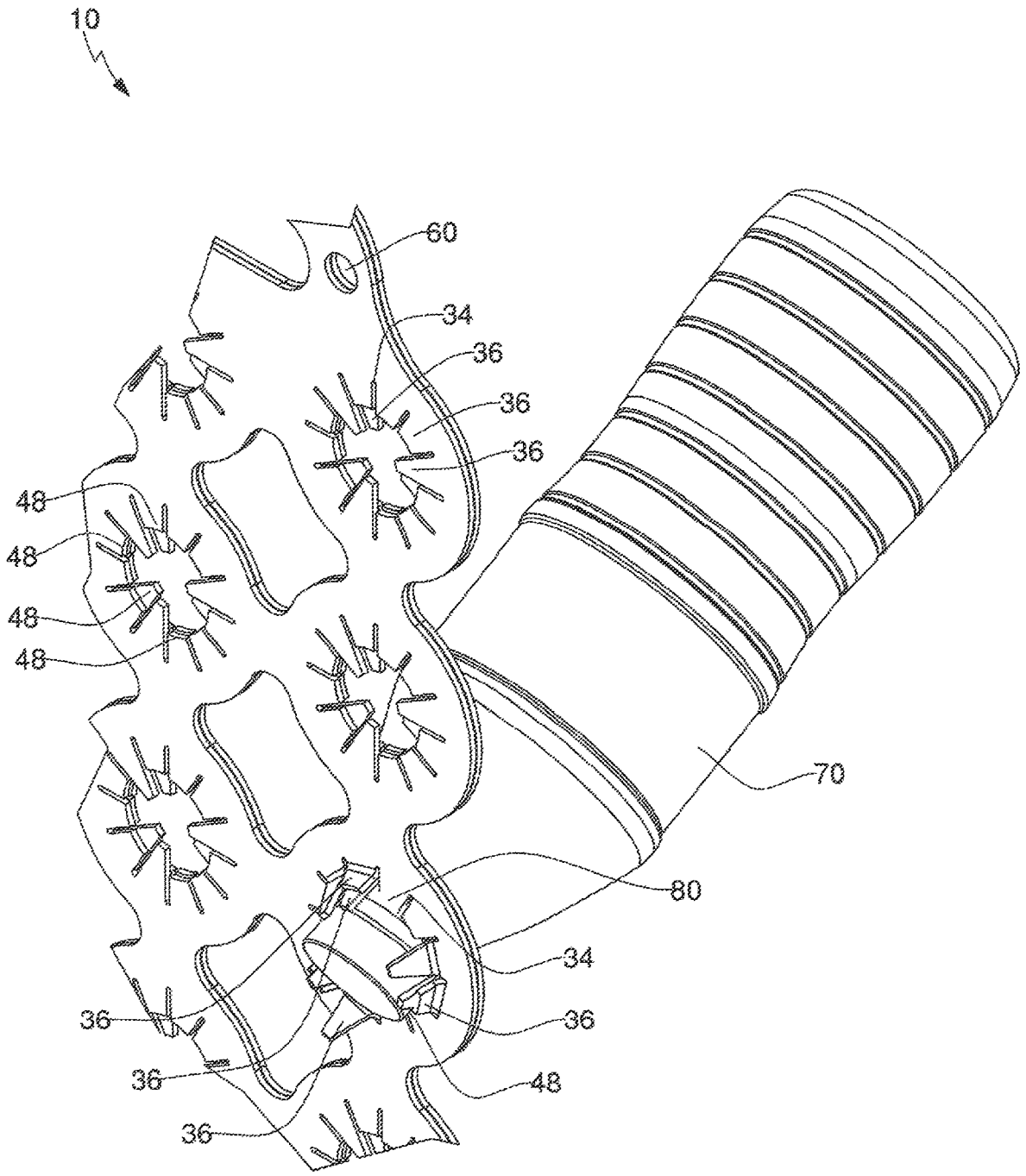
FIG. 14 is an orthographic view showing a bottle being extracted from the BRAAP structure by a first method consisting of pressing the downward at an angle.
Figure 15:
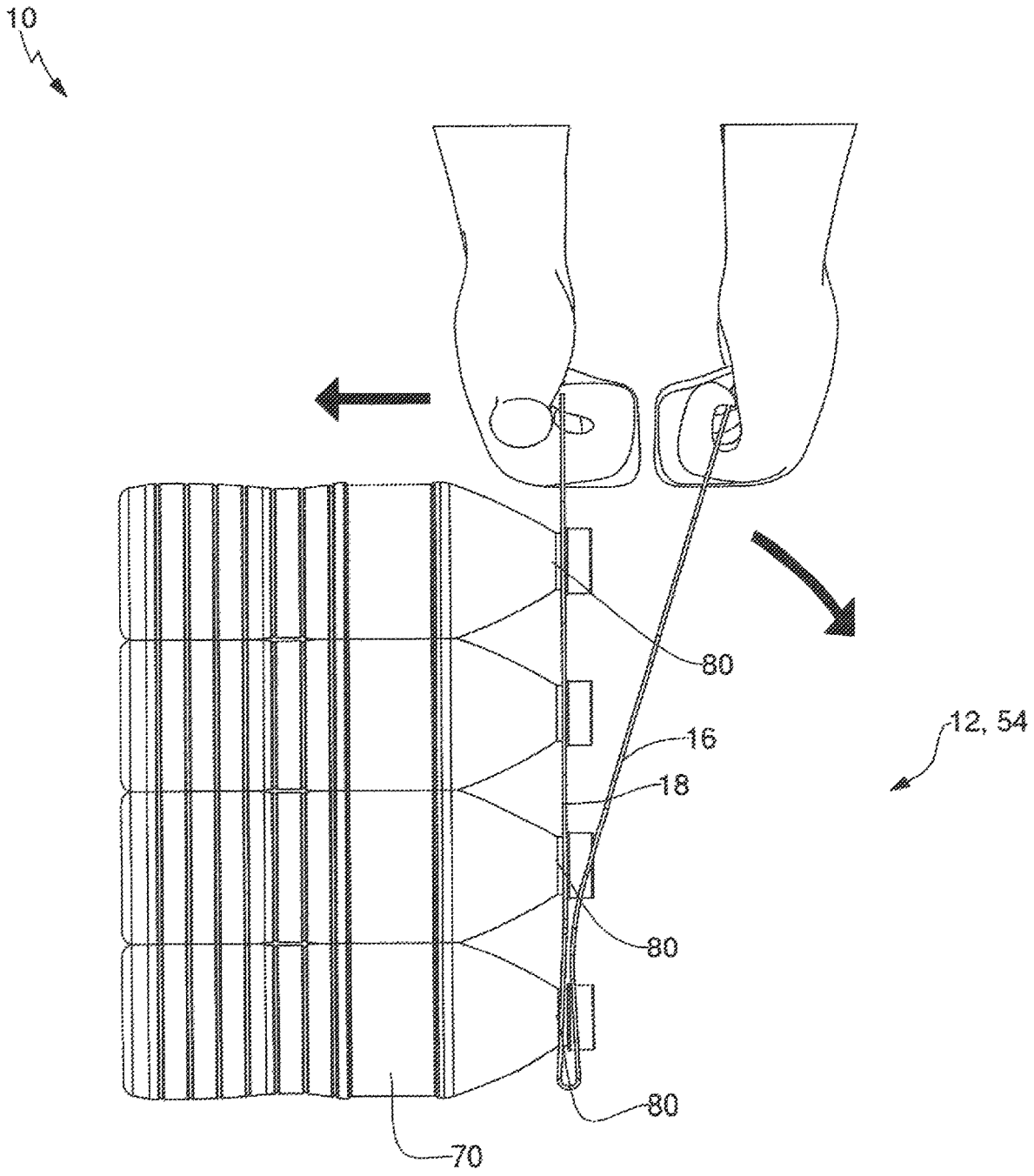
FIG. 15 is a side elevational view showing multiple bottles being extracted from the BRAAP folded structure by a second method consisting of grasping each of the two handles and pulling the folded ends of the structure apart in opposite directions, which results in only half the normal required to extract the bottles.

When using the folded strip 38 there are two methods of extracting bottles from the strip. For the first method an individual bottle is simply pressed downward at an angle, as shown in FIG. 14, thereby removing the retaining force on the bottle. For the second method the two folded handles 40 are pulled apart in opposite directions, as shown in FIG. 15. The pulling action separates the folded strip 38, thereby reduces the retaining force on the bottles and allowing the bottles to be sequentially extracted one row at a time.

Figure 10:
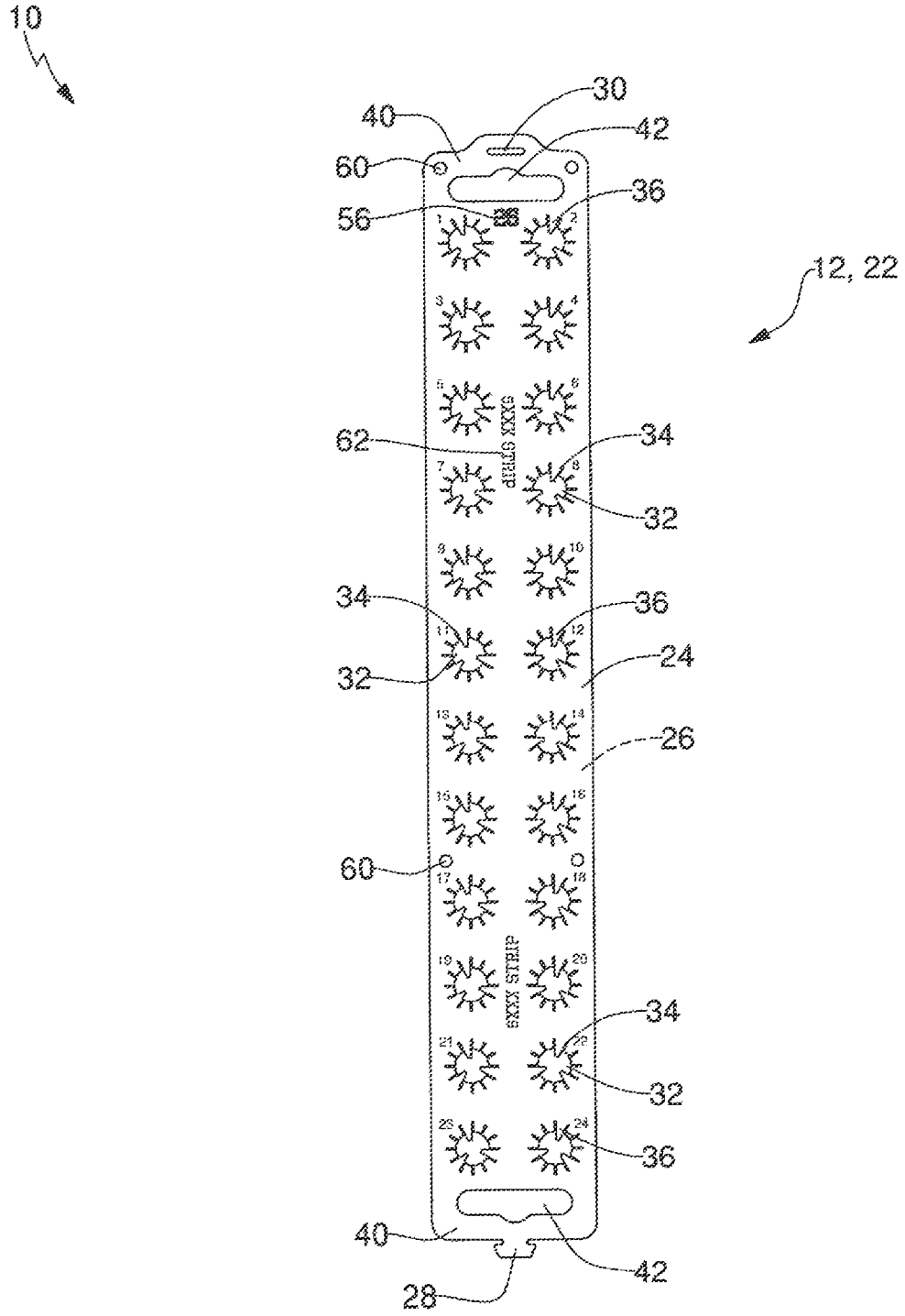
FIG. 10 is a top plan view of the BRAAP showing first numerical indicators of the number of bottles on the strip and a second numerical indicator of the redemption value of the bottles on the strip.
Figure 12:
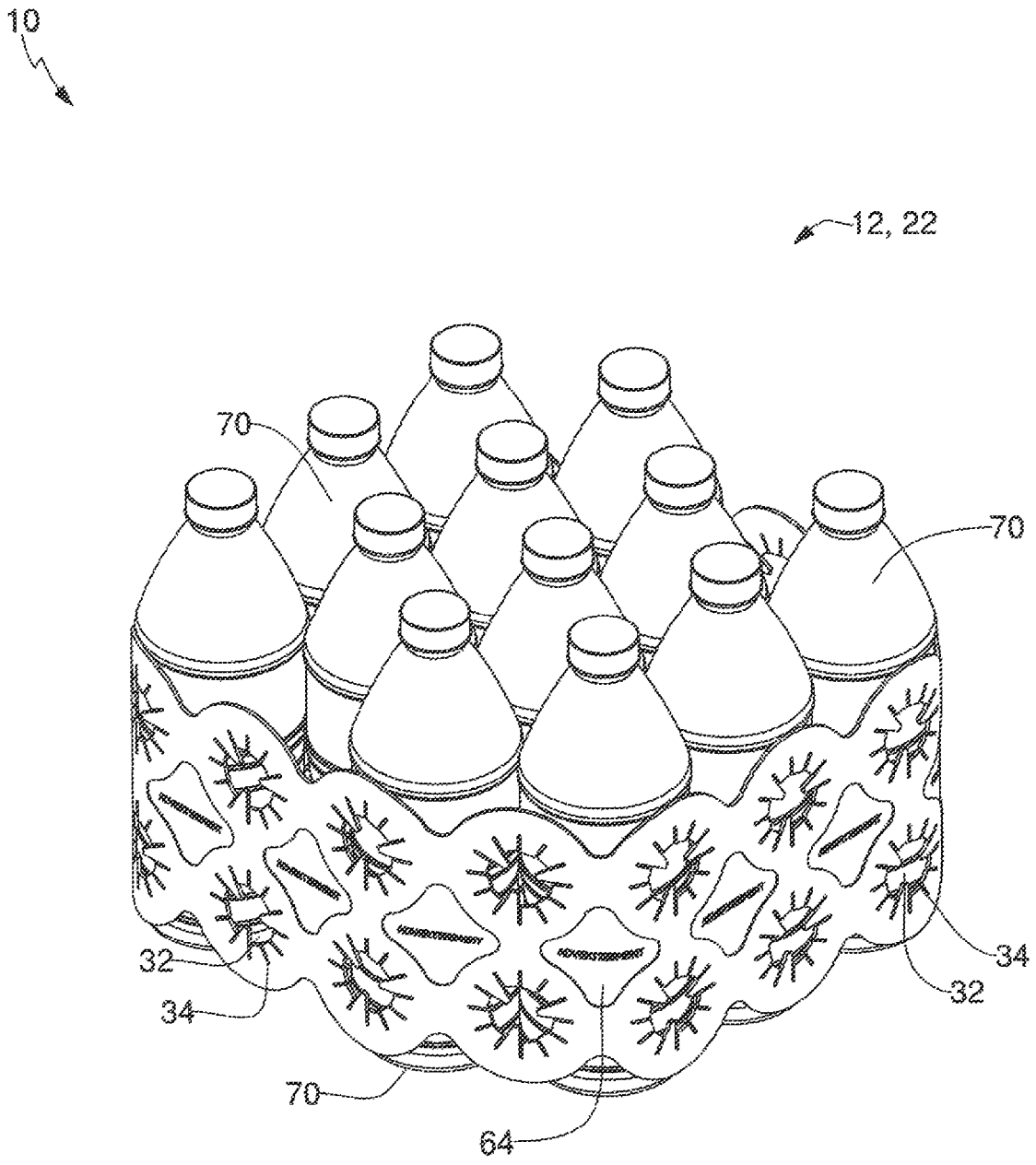
FIG. 12 is an orthographic view of a strip wrapped around multiple plastic bottles.
Figure 13:
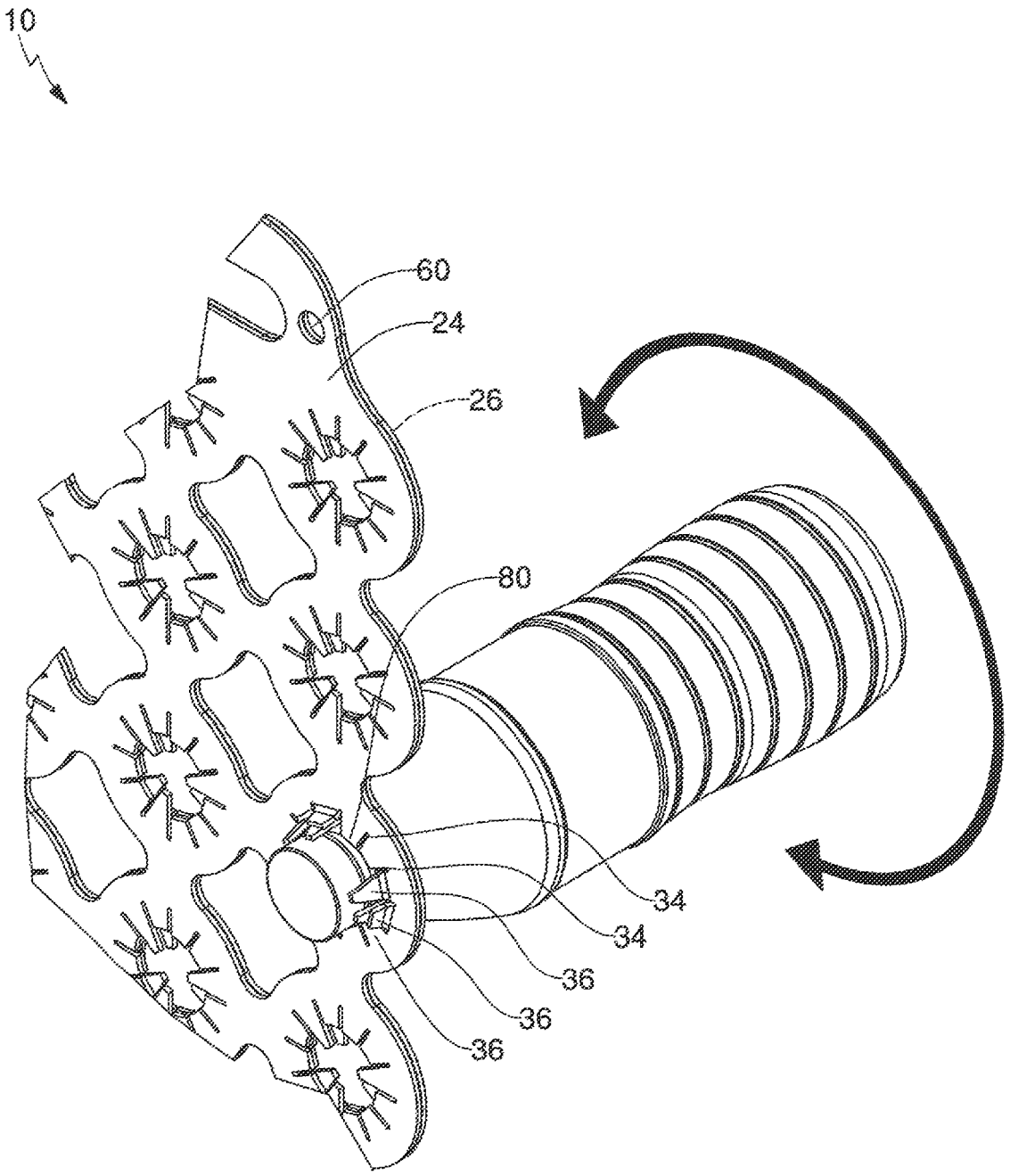
FIG. 13 is an orthographic view of the BRAAP structure, with a tab interfacing with the bottle cap and threads on the bottle neck, thereby producing an inward pulling action around the thread helix which reduces the amount of force necessary to insert the bottle.
Figure 23:
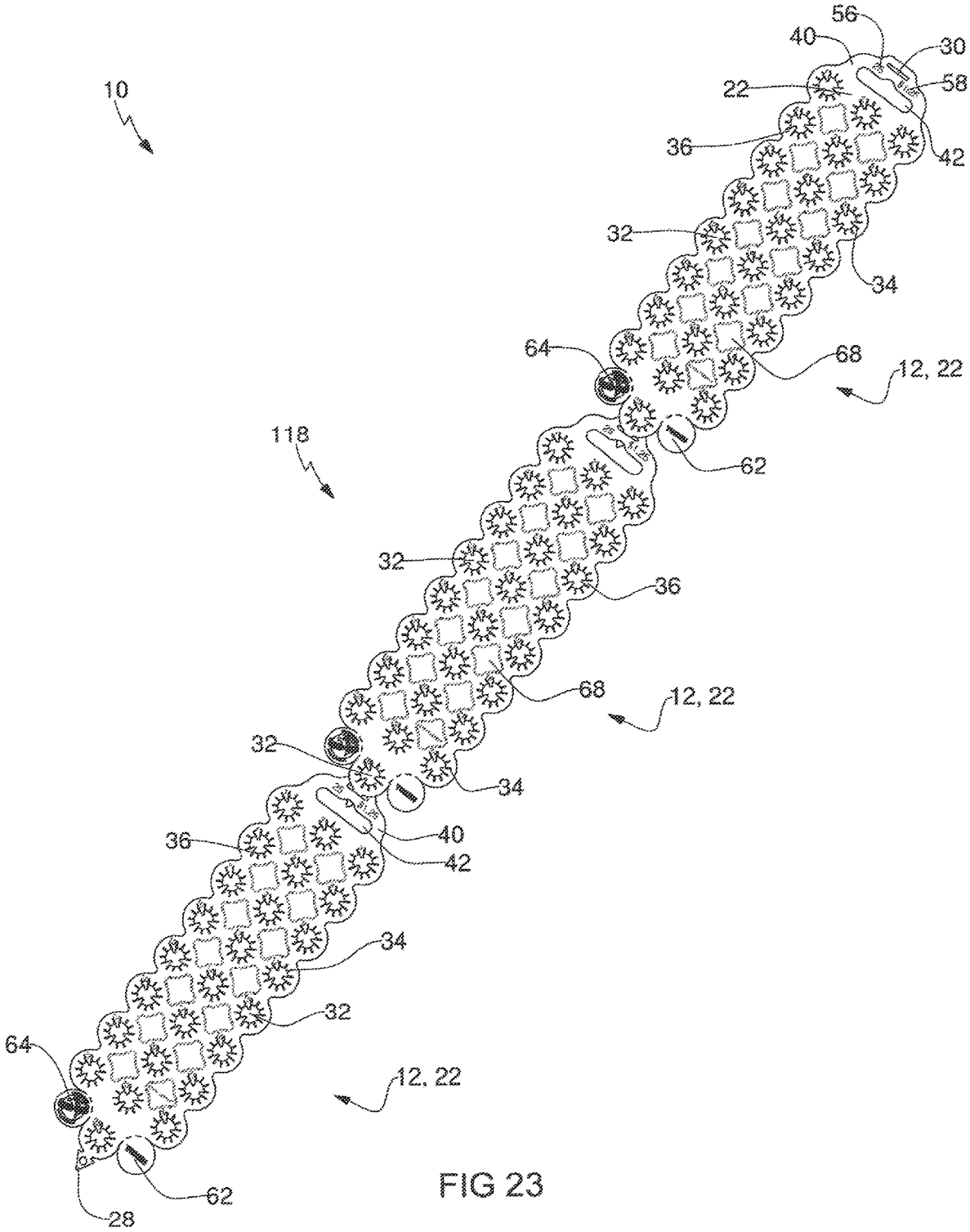
FIG. 23 is a top plan view of multiple strips interlocked together by inserting an insertion member on an upper end of one strip into an end slot on a lower end of another strip, and then repeating for successive strips.

To add to the functionality of the strip 22, as shown in FIG. 12, preferably at one end of the strip is an insertion member 28 and at an opposite end is an end slot 30, as shown in FIGS. 6 and 10. The insertion member 28 and end slot 30 can only function when the strip 22 is made of a flexible, resilient material. Two corner sections of the insertion member 28 can be bent inward, and the end slot 30 is dimensioned to allow the insertion member 28 with bent corner sections to be inserted through the slot 30. Once the insertion member 28 is inserted, the two corners expand back to their original shape, thereby securing the insertion member/one end to the end slot/opposing end. One of the best uses of this capability is to daisy chain or inter lock multiple strips 22 together, as shown in FIG. 23.

The panel 14 and the strip 22 can be re-used numerous times, or they can be disposable after a single use or a certain number of uses. It is this variety of characteristics and functional capabilities that make the BRAAP 10 the optimal choice for retaining plastic beverage bottles.

Figure 17:
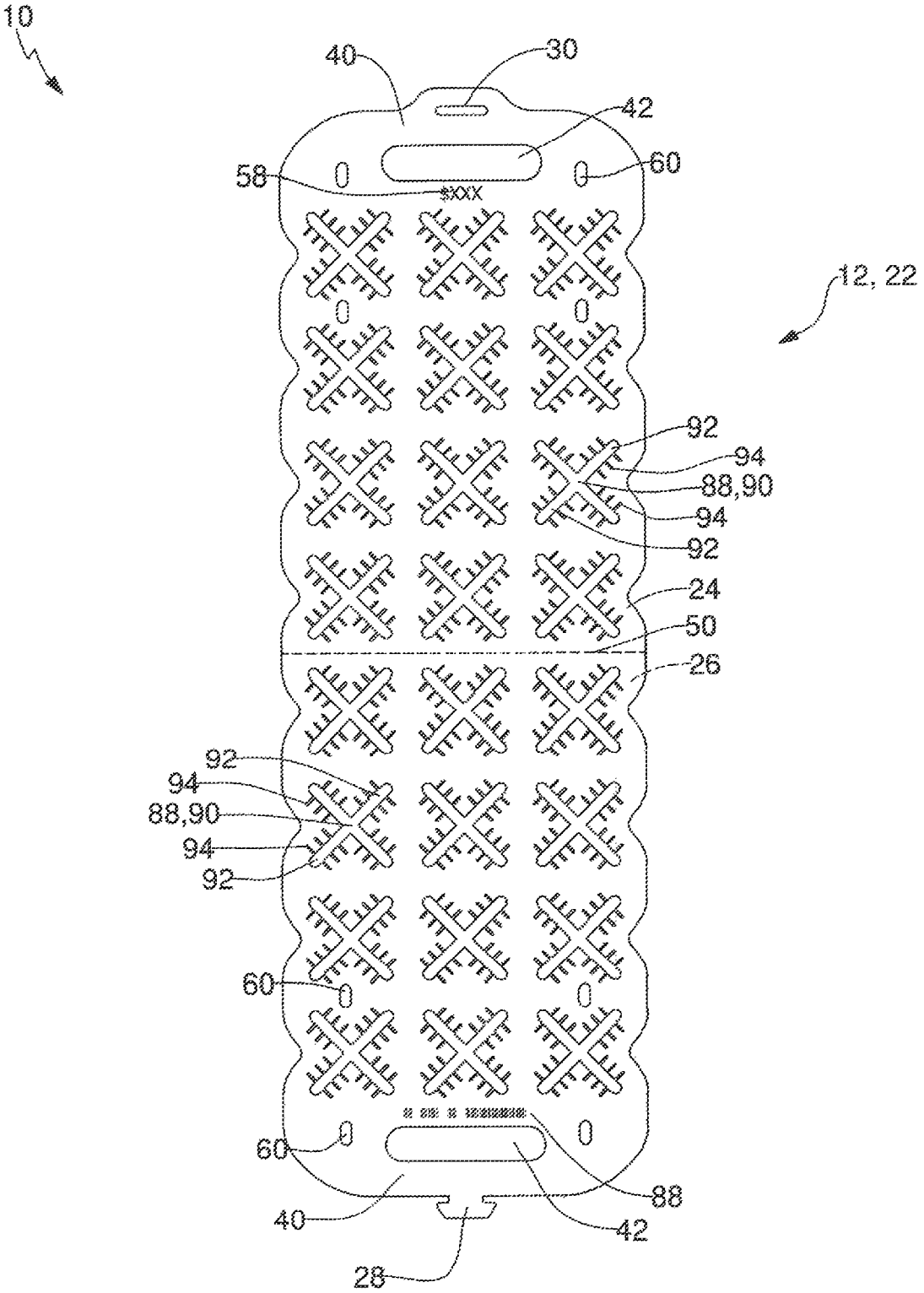
FIG. 17 is an elevational front view of the strip with X-oriented openings.
Figure 18:
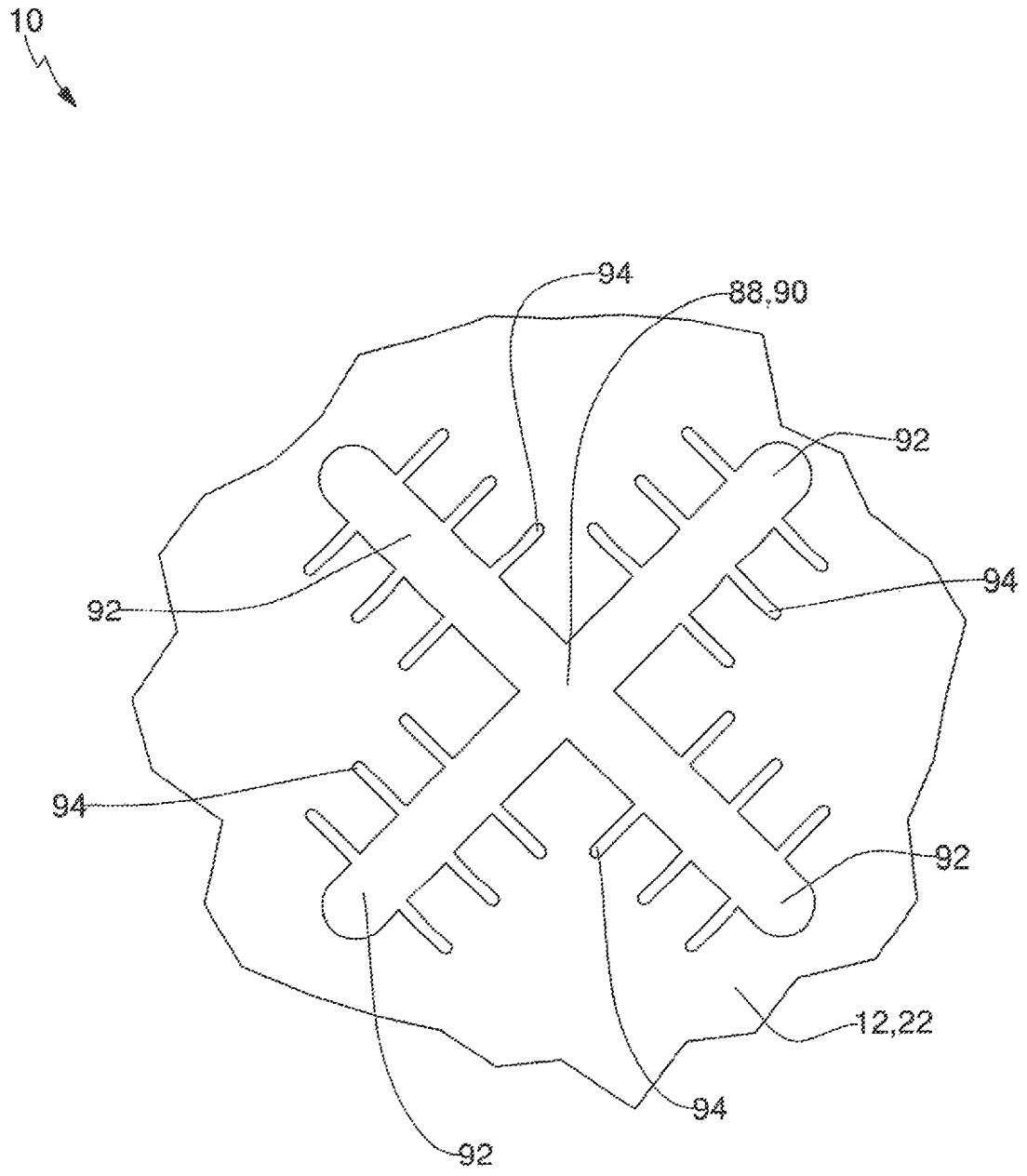
FIG. 18 is a detail view of one of the X-oriented openings showing perpendicular slots, arms and outward extending slits.
Figure 19:
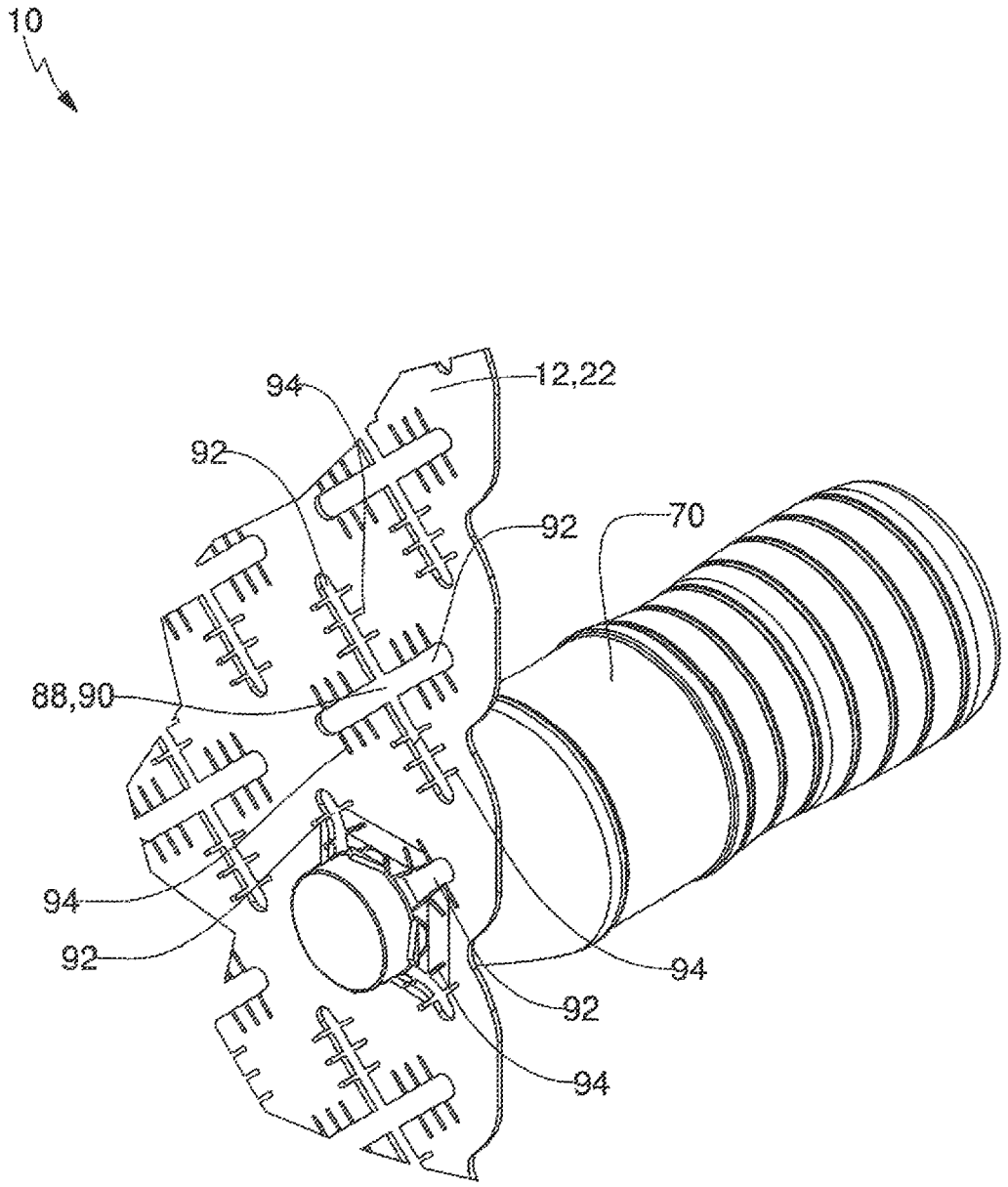
FIG. 19 is an orthographic view of a bottle attached to the strip by being inserted and maintained within one of the X-oriented openings.

As shown in FIGS. 1-19, both the panel 14 and the strip 22 have at least one, and preferably multiple, openings 32. Each opening 32 is dimensioned to allow a bottle's neck to be inserted and maintained within the opening 32, or removed from the opening 32. When a bottle(s) 70 is inserted into an opening 32, the BRAAP 10 with the retained bottle(s) can be stored or transported. Even with a multiplicity of bottles 70 on a single BRAAP 10, the BRAAP 10 is still light enough to be carried by, and managed by, one person, even a child or elderly individual. When an inserted bottle 70 is pulled from an opening 32, the bottle's neck easily comes out of the opening, thereby allowing the bottle 70 to be removed from the BRAAP 10. In order to allow the opening 32 to accept bottle necks that may be larger than the typical size, each opening 32 can have one or more slits 34 and tabs 36. As shown in FIGS. 2-6, each slit 34 radially extends outward from an edge of the opening 32 and the tabs 36, which are preferably triangular shaped, extend inward partially into the opening 32 from the edge. The slits 34 and tabs 36 allows the panel 14 or strip 22 material adjacent to the opening 32 to flex, thereby enlarging the opening 32 and facilitating the insertion of a bottle neck that is larger than the opening 32. The slits 34 and tabs 36 then apply pressure onto the bottle's neck, thereby captively maintaining the bottle on the panel or strip. The tabs 36 also interface with the threads on a bottle's neck and provide an assisted insertion of the bottle neck into the opening as the neck is twisted into the opening 32. An alternate design of the opening 32, as shown in FIGS. 17-19, is comprised of an X-oriented opening 88 having two perpendicular slots 90 with four arms 92. Extending outward from a first inner edge and a second inner edge of each slot arm 92 is at least one slit, as best shown in FIG. 18. When a bottle is inserted into the X-oriented opening 88 the combined use of the slots and at least one slit(s) produces a dual force retention interface on the bottle's neck, thereby securely retaining the bottle within the opening 88 and attached to the strip 22.

In order to optimize the functionality of the BRAAP 10, and to conserve and effectively use space, bottles can be inserted/removed from both surfaces of the panel 14 or strip 32. A bottle can be inserted downward into an opening 32 from the upper surface 16,24 of the panel 14 or strip 32, or a bottle can be inserted upward into an opening 32 from the lower surface 18,26 of the panel 14 or strip 22. Additionally, to increase the capability, a concave or convex dimple (not shown) can be located above or below each opening, depending on how a bottle is inserted from the upper or lower surface.

As shown in FIGS. 1, 3-6, 9-11, 15-17 and 21, the panel 14 and strip 22 can each also have an integral or non-integral handle 40 to facilitate the gripping carrying of the structure 12. Preferably, the handle 40 is comprised of an opening 42 that extends through the panel 14 or strip 22. A person simply inserts one or more fingers into the opening 42 and grips. Additionally, the handle opening 42 can have an indented slot 44 located at the substantial center of an upper edge. The slot 44 allows the BRAAP 10 to be hooked onto and suspended from a protrusion or hook on a wall or other surface. The slot 44 on the opening 42 also allows a panel 14 or strip to be hung from common household fixtures, such as a doorknob.

As previously disclosed, multiple panels 14 and/or strips 22 can be interlocked together to create a combined larger BRAAP 10 which is capable of carrying, storing and transporting a larger number of plastic bottles 70. The attachment means (not shown) can be comprised of snap closure, male and female interfaces, clamps, hook and loop fasteners or any other similar devices.

Also, as shown in FIG. 11, at least two of the strips can be removably attached together to create a single structure, with a score mark 50 longitudinally extending from an upper edge to a lower edge between the strips. One of the strips is manually pulled away and extricated from another strip. Multiple strips can be manufactured, sold and accessed as a single structure, with individual strips removed as needed.

A strip 22 can be wrapped around a single bottle or a strip 22 can be wrapped around a group of multiple bottles, such as a 12-pack, as shown in FIG. 12. For convenience multiple strips can be rolled into a unitary, circular structure, or folded into a unitary, substantially rectangular structure. To add to the functionality of a rolled circular structure, a dispenser 76 can be utilized. The dispenser 76 is comprised of a base with an upward extending vertical member located at the center of the rolled circular structure is an opening that extends through from an upper end to a lower end. The rolled circular structure is placed on the dispenser by aligning the lower end opening with the vertical member and sliding the circular structure downward as the vertical member extends upward into the opening. Once the circular structure is placed on the dispenser, one (or more) strips can be removed from the rolled circular structure as needed.

Alternately, the dispenser can be comprised of a horizontal member (not shown) that is hingedly attached at one end and removably attached at the other end to a surface such as a wall. The removably attached end is disengaged from the horizontal member, thereby allowing the member to swing outward, pivoting on the hinged attachment end. In the outward position, the rolled circular structure can be placed on the horizontal member in the same manner as the structure is placed on the vertical member. Once the circular structure is on the horizontal member, both the structure and the member are swung back into position with the removably attached end secured. One (or more) strips can then be pulled outward/downward and removed from the rolled circular structure as needed.

Figure 2:
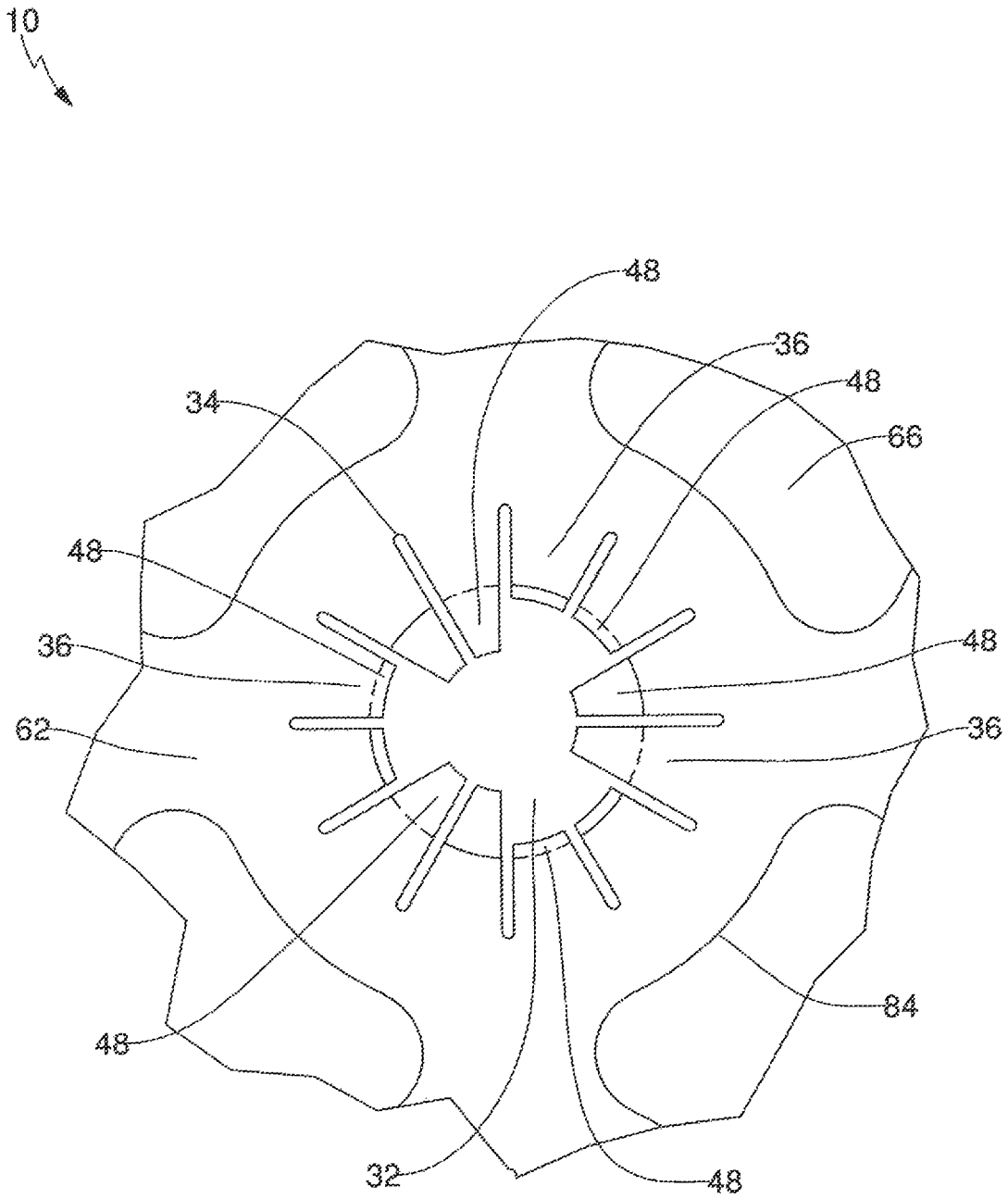
FIG. 2 is a detail view of the BRAAP opening that is folded and doubled, and showing tabs and slits that are in an offset orientation.

To increase the marketability and use of the BRAAP 10, the structure 12 can be folded at least once. A folded strip 38 or panel 54 has a length and width that are less than the length and width of an un-folded structure. As shown in FIGS. 4 and 5, the folded strip 38 or panel 54 is placed in or on a package of multiple plastic beverage bottles prior to sale or transportation. A person who purchases a package of plastic bottle beverages also receives the BRAAP 10, which is an incentive to use the BRAAP 10. The structure can also be folded at the substantial lateral midline, either with a score mark 50, as shown in FIG. 3, or without a score mark, thereby doubling the thickness of the strip. The folded structure openings have at least two tabs and at least two slits and when the structure is folded, the openings are doubled and aligned, with the tabs and slits in an offset pattern 48, as shown in FIG. 2. The folded strip 38 or panel 54 produces a two stage insertion engagement of the bottles: a first stage provides increased initial interfacing of the bottle in the opening, and a second stage creates a locking force that secures the bottle within the opening.

Additionally, the BRAAP 10 provides fraud detection by positioning the bottles in a complete static display. A person can visually ascertain, in three dimensions, the cash redemption value band on each bottle and/or a manufacturer's identification mark. A person can also quickly and easy count the number of bottles on a panel or strip, with every cavity or space in/on a bottle visible. To add to his capability, each panel or strip can include first numerical indicators 56, as shown in FIGS. 10 and 11, that show the total number of bottles a particular size strip or panel can maintain. A second numerical indicator 58, as shown in FIG. 6, shows the current redemption value amount of a panel or strip with all attached bottles, manufacturer identification instructions for use, and/or other pertinent related information. Preferably, the first numerical indicator 56 is located adjacent one or both of the handle openings 42 and/or adjacent each of the openings 32, and the second numerical indicator 58 is located adjacent one or both of the handle openings 42.

Another important feature is that crushed plastic bottles cannot be recycled due to possible contamination and because electronic viewers can not recognize a crushed bottle. By allowing a person to view all the bottles on a panel or strip, a quick and accurate identification of crushed bottle(s) can be made when the panel or strip is removed. The bottles are squeezed and can be punctured, which releases any air of residual fluid in the bottle(s). This greatly aids in the subsequent compaction of the bottle(s). Also, the panel or strip can be removed by simply pulling, which results in an opposing force that peels a panel or strip away from the bottle's cap.

Although, the BRAAP 10 is highly effective as both a retaining apparatus and an advertising platform, it is feasible to produce a strip 22 or panel 14 without advertising or promotional indicia, as shown in FIGS. 1, 4, 9 and 10. Without the advertising or promotional indicia, the functionality of the strip 22 or panel 14 is limited to retaining related uses such as packaging, collection, storage, transportation and display of plastic bottles. Other uses can also be realized such as the counting or inspection of plastic bottles. While the removal of the advertising and promotional indicia does narrow the utility of the invention, a plastic bottle retaining apparatus is still an effective, valuable and unique propriety concept.

Figure 22:
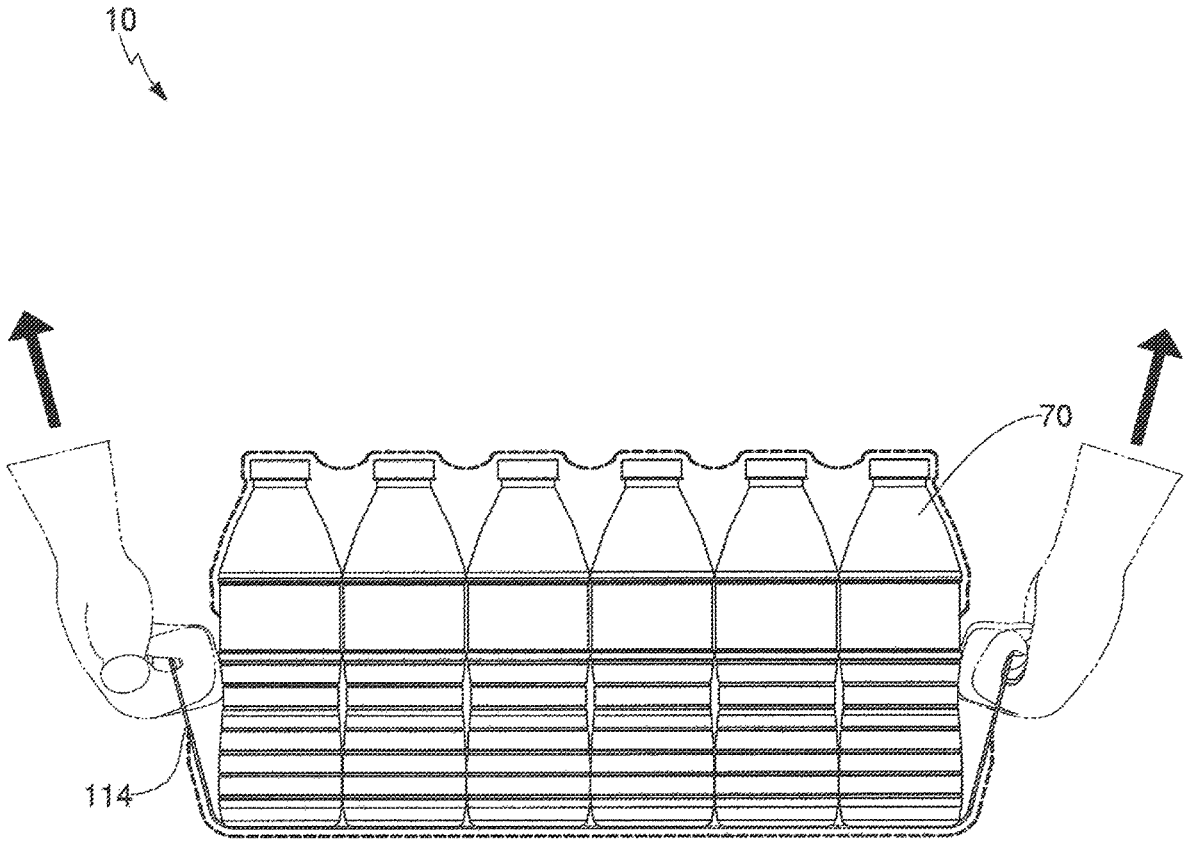
FIG. 22 is an elevational side view of a strip placed below a package of multiple bottles, and the strip and packaged bottle being lifted together by hands gripping an end section of the strip.

An alternate function the BRAAP consists of placing the strip 22 on panel 14 on a lower surface of a package of multiple beverage bottles, which is identified as number 114. One end section of the strip or panel extends from each end of the packaged bottles. The two extending end sections are gripped by a person's hands and pulled up, as shown in FIG. 22, thereby raising the strip/panel and the packaged bottles together. This allows the packaged bottles to be hand carried or transported.

It should be noted that the use of the BRAAP 10 is not intended to be limited to the uses disclosed herein. It is anticipated that a future addition to the system will include a proprietary machine that facilitates the recycling when any of the designs of the BRAAP 10 is used. The machine will be purpose-built and designed to accept groups of bottles attached to the panel or strip, or retained by the band. The machine will optimally be placed in a clean, well-lit location that is inviting for use. The machine will also be easy and quick to use and will encourage people to use the panel, strip and/or band. Additionally, the machine can be associated with a retail location such as a supermarket, and in cooperation with the supermarket, the machine can dispense tickets or vouchers that can be redeemed for cash or merchandise in the supermarket. Also, proprietary and non-proprietary storage means and apparatus are envisioned. The storage means/apparatus will be a component of and significantly increase the functionality of the system 10 by facilitating the convenient, clean and space-saving storage of plastic bottles.

In addition to the advertising and promotional indicia including recycling or non-recycling information, other indicia such as lottery numbers can be used. Also, to provide digital or web-based information available directly from the strip 22 or panel 24, a barcode, QR reader 78, or radio frequency identification tag (RFID) can be placed on the strip 22 or panel 14, as shown in FIG. 8. The barcode, QR reader or RFID tag can allow a manufacturer to inventory or track packages of full bottles, or for information pertaining to advertising or special commercial offers to be provided to consumers via a smartphone app. Of course, there are just examples of a potential future expansion and use. Other possibilities exist and will become apparent especially as the requirement of addressing the problems associated with plastic bottles are some of the most prevalent issues in the world.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. A plastic bottle retaining apparatus and advertising platform, that includes advertising or promotional indicia applied on the BRAAP, wherein said BRAAP comprises a structure having at least one opening that is dimensioned to allow a bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein the structure further comprises at least one cavity, and located within at least one cavity is said advertising or promotional indicia.

2. A plastic bottle retaining apparatus and advertising platform, that includes advertising or promotional indicia applied on the BRAAP, wherein said BRAAP comprises a structure having at least one opening that is dimensioned to allow a bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure further comprises at least one punch-out section, wherein located on at least one punch-out section is said advertising or promotional indicia.

3. A plastic bottle retaining apparatus and advertising platform that includes advertising or promotional indicia applied on the BRAAP, wherein said BRAAP comprises a structure having at least one opening that is dimensioned to allow a bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, further comprising at least one punch-out section having at least one pull-tab that allows said punch-out section to be grasped, thereby facilitating the extraction of said pull-tab.

4. A plastic bottle retaining apparatus and advertising platform that includes advertising or promotional indicia applied on the BRAAP, wherein said BRAAP comprises a flexible strip having a plurality of openings, with each opening dimensioned to allow a bottle neck to be inserted or removed in a twisting motion, wherein extending inward from an inner perimeter edge of each opening is at least one tab, wherein when a bottle neck is inserted into said opening, said tab flexibly interfaces with bottle cap threads that circumvent the bottle's neck, wherein said tab follows a helix pattern along the threads on the bottle neck, wherein after a tab initially flexibly interfaces with the threads and begins the twisting motion, the tabs will follow the helix pattern, thereby reducing the amount of force necessary to fully insert the bottle neck into said opening, effectively providing assisted insertion of the bottle neck, wherein once a bottle neck is inserted into said opening, said BRAAP retains the bottle wherein when an inserted bottle neck is twisted out of said opening, the bottle is released, thereby allowing the bottle to be removed from said BRAAP.

5. A plastic bottle retaining apparatus and advertising platform that includes advertising or promotional indicia applied on the BRAAP, wherein said BRAAP comprises a flexible strip having a plurality of openings, with each opening dimensioned to allow a bottle neck to be inserted or removed in a twisting motion, wherein extending inward from an inner perimeter edge of each opening is at least one tab, wherein when a bottle neck is inserted into said opening, said tab flexibly interfaces with bottle cap threads that circumvent the bottle's neck, wherein said tab follows a helix pattern along the threads on the bottle neck, wherein after a tab initially flexibly interfaces with the threads and begins the twisting motion, the tabs will follow the helix pattern, thereby reducing the amount of force necessary to fully insert the bottle neck into said opening, effectively providing assisted insertion of the bottle neck, wherein once a bottle neck is inserted into said opening, said BRAAP retains the bottle, wherein when an inserted bottle neck is twisted out of said opening, the bottle is released, thereby allowing the bottle to be removed from said BRAAP, wherein extending inward from an inner perimeter edge of each opening are at least two tabs.

6. A plastic bottle retaining apparatus and advertising platform that includes advertising or promotional indicia applied on the BRAAP, wherein said BRAAP comprises a flexible strip having a plurality of openings, with each opening dimensioned to allow a bottle neck to be inserted or removed in a twisting motion, wherein extending inward from an inner perimeter edge of each opening is at least one tab, wherein when a bottle neck is inserted into said opening, said tab flexibly interfaces with bottle cap threads that circumvent the bottle's neck, wherein said tab follows a helix pattern along the threads on the bottle neck, wherein after a tab initially flexibly interfaces with the threads and begins the twisting motion, the tabs will follow the helix pattern, thereby reducing the amount of force necessary to fully insert the bottle neck into said opening, effectively providing assisted insertion of the bottle neck, wherein once a bottle neck is inserted into said opening, said BRAAP retains the bottle, wherein when an inserted bottle neck is twisted out of said opening, the bottle is released, thereby allowing the bottle to be removed from said BRAAP, wherein said tab has a shape that is selected from the group consisting of triangular, square, and semi-circular.

7. A plastic bottle retaining apparatus and advertising platform that includes advertising or promotional indicia applied on the BRAAP, wherein said BRAAP comprises a flexible strip having a plurality of openings, with each opening dimensioned to allow a bottle neck to be inserted or removed in a twisting motion, wherein extending inward from an inner perimeter edge of each opening is at least one tab, wherein when a bottle neck is inserted into said opening, said tab flexibly interfaces with bottle cap threads that circumvent the bottle's neck, wherein said tab follows a helix pattern alone the threads on the bottle neck, wherein after a tab initially flexibly interfaces with the threads and begins the twisting motion, the tabs will follow the helix pattern, thereby reducing the amount of force necessary to fully insert the bottle neck into said opening, effectively providing assisted insertion of the bottle neck, wherein once a bottle neck is inserted into said opening, said BRAAP retains the bottle, wherein when an inserted bottle neck is twisted out of said opening, the bottle is released, thereby allowing the bottle to be removed from said BRAAP, wherein said tab further comprising a serrated edge.

8. A plastic bottle retaining apparatus and advertising platform that includes advertising or promotional indicia applied on the BRAAP, wherein said BRAAP comprises a flexible strip having a plurality of openings, with each opening dimensioned to allow a bottle neck to be inserted or removed in a twisting motion, wherein extending inward from an inner perimeter edge of each opening is at least one tab, wherein when a bottle neck is inserted into said opening, said tab flexibly interfaces with bottle cap threads that circumvent the bottle's neck, wherein said tab follows a helix pattern along the threads on the bottle neck, wherein after a tab initially flexibly interfaces with the threads and begins the twisting motion, the tabs will follow the helix pattern, thereby reducing the amount force necessary to fully insert the bottle neck into said opening, effectively providing assisted insertion of the bottle neck, wherein once a bottle neck is inserted into said opening, said BRAAP retains the bottle, wherein when an inserted bottle neck is twisted out of said opening, the bottle is released, thereby allowing the bottle to be removed from said BRAAP, wherein said opening further comprising at least two slits that extend outward from an inner perimeter edge, wherein said slits in combination with said tabs allow panel material adjacent to said opening to flex, thereby enlarging said opening and facilitating the insertion of a bottle neck that is larger than said opening.

9. A plastic bottle retaining apparatus and advertising platform that includes advertising or promotional indicia applied on the BRAAP, wherein said BRAAP comprises a flexible strip having a plurality of openings, with each opening dimensioned to allow a bottle neck to be inserted or removed in a twisting motion, wherein extending inward from an inner perimeter edge of each opening is at least one tab, wherein when a bottleneck is inserted into said opening, said tab flexibly interfaces with bottle cap threads that circumvent the bottle's neck, wherein said tab follows a helix pattern along the threads on the bottle neck, wherein after a tab initially flexibly interfaces with the threads and begins the twisting motion, the tabs will follow the helix pattern, thereby reducing the amount of force necessary to fully insert the bottle neck into said opening, effectively providing assisted insertion of the bottle neck, wherein once a bottle neck is inserted into said opening, said BRAAP retains the bottle, wherein when an inserted bottle neck is twisted out of said opening, the bottle is released, thereby allowing the bottle to be removed from said BRAAP, wherein said structure is folded at least once, wherein said folded structure facilitates alignment of said openings for insertion and engagement of full bottles, wherein said folded structure is placed in or on a package of multiple plastic beverage bottles prior to sale or transportation, wherein when a person purchases a package of plastic bottled beverages, said BRAAP is also present and useable.

10. A plastic bottle retaining apparatus and advertising platform (BRAAP) that includes advertising or promotional indicia applied on the BRAAP, wherein said BRAAP comprises a flexible strip having a plurality of openings, with each opening dimensioned to allow a bottle neck to be inserted or removed, wherein said strip is folded at the substantial lateral midline thereby doubling the thickness of said strip, wherein said folded strip openings have at least two tabs and at least two slits, wherein when said strip is folded, said openings are doubled and aligned, with said tabs and said slits in an offset pattern, wherein said folded strip produces a two stage insertion engagement of the bottles, a first stage provides increased initial interfacing of the bottle in said opening, and a second stage creates a locking force that secures the bottle within said opening.

11. A plastic bottle retaining apparatus and advertising platform (BRAAP) tat includes advertising or promotional indicia applied on the BRAAP, wherein said BRAAP comprises a flexible strip having a plurality of openings, with each opening dimensioned to allow a bottle neck to be inserted or removed, wherein said strip is folded at the substantial lateral midline thereby doubling the thickness of said strip, wherein said folded strip openings have at least two tabs and at least two slits, wherein when said strip is folded, said openings are doubled and aligned with said tabs and said slits in an offset pattern, wherein said folded strip produces a two stage insertion engagement of the bottles, a first stage provides increased initial interfacing of the bottle in said opening, and a second stage creates a locking force that secures the bottle within said opening, wherein said folded strip two stage engagement produces reduced friction when a full bottle is inserted into said doubled opening since the bottle does not engage all contact points simultaneously.

12. A plastic bottle retaining apparatus and advertising platform (BRAAP) that include advertising or promotional indicia applied on the BRAAP, wherein said BRAAP comprises a flexible strip having a plurality of openings, with each opening dimensioned to allow a bottle neck to be inserted or removed, wherein said strip is folded at the substantial lateral midline thereby doubling the thickness of said strip, wherein said folded strip openings have at least two tabs and at least two slits, wherein when said strip is folded, said openings are doubled and aligned with said tabs and said slits in an offset pattern, wherein said folded strip produces a two stage insertion engagement of the bottles, a first stage provides increased initial interfacing of the bottle in said opening, and a second stage creates a locking force that secures the bottle within said opening, wherein to extract an individual bottle from said folded strip the two folded handles are pulled apart in opposite directions, wherein the pulling action separates said folded strip, thereby removing the retaining force on the bottles, and allowing the bottles to be sequentially extracted one row at a time.

13. A The plastic bottle retaining apparatus and advertising platform (BRAAP) that includes advertising or promotional indicia applied on the BRAAP, wherein said BRAAP comprises a flexible strip having a plurality of openings, with each opening dimensioned to allow a bottle neck to be inserted or removed, wherein said strip is folded at the substantial lateral midline thereby doubling the thickness of said strip, wherein said folded strip openings have at least two tabs and at let two slits, wherein when said strip is folded, said openings are doubled and aligned with said tabs and said slits in an offset pattern, wherein said folded strip produces a two stage insertion engagement of the bottles, a first stage provides increased initial interfacing of the bottle in said opening, and a second stage creates a locking force that secures the bottle within said opening, further comprising a peripheral reinforcement that surrounds advertising cavities or punch-outs, wherein said reinforcement provides increased structural strength around the cavities or punch-outs to ensure the cavities or punch-outs do not inadvertently detach from said strip.

14. A plastic bottle retaining apparatus and advertising platform (BRAAP) that includes advertising or promotional indicia applied on the BRAAP, wherein said BRAAP comprises a flexible strip having a plurality of openings, with each opening dimensioned to allow a bottle neck to be inserted or removed, wherein said strip is folded at the substantial lateral midline thereby doubling the thickness of said strip, wherein said folded strip openings have at least two tabs and at least two slits, wherein when said strip is folded, said openings are doubled and aligned with said tabs and said slits in an offset pattern, wherein said folded strip produces a two stage insertion engagement of the bottles, a first stage provides increased initial interfacing of the bottle in said opening, and a second stage creates a locking force that secures the bottle within said opening, wherein said strip further comprising a pull-tab on a cavity or punch-out, wherein said the pull-tab facilitates the removal by hand of the cavity or punch-outs.

15. A plastic bottle retaining apparatus and advertising platform (BRAAP) that includes advertising or promotional indicia applied on the BRAAP, wherein said BRAAP comprises a structure having at least ne opening that is dimensioned to allow an bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure is placed on a lower surface of a package of multiple beverage bottles, with the BRAAP in contact with the lower surface of the package and one end section of said structure extending from each end of the packaged bottles, wherein the two extending end sections are gripped by a person's hands and pulled upward thereby raising said structure and the packaged bottles together, allowing the packaged bottles to be hand carried or transported.

16. A plastic bottle retaining apparatus and advertising platform (BRAAP) that includes advertising or promotional indicia applied on the BRAAP, wherein said BRAAP comprises a structure comprising an upper surface and a lower surface, said structure having at least one opening that is dimensioned to allow an bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure is placed on a lower surface of a package of multiple beverage bottles, with the BRAAP in contact with the lower surface of the package and one end section of said structure extending from each end of the packaged bottles, wherein the two extending end sections are gripped by a person's hands and pulled upward thereby raising said structure and the packaged bottles together, allowing the packaged bottles to be hand carried or transported.

17. A plastic bottle retaining apparatus and advertising platform (BRAAP) that includes advertising or promotional indicia applied on the BRAAP, wherein said BRAAP comprises a structure wherein said structure is comprised of a strip with an upper surface and a lower surface, said strip having at least one opening that is dimensioned to allow an bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure is placed on a lower surface of a package of multiple beverage bottles, with the BRAAP in contact with the lower surface of the package and one end section of said structure extending from each end of the packaged bottles, wherein the two extending end sections are gripped by a person's hands and pulled upward thereby raising said structure and the packaged bottles together, allowing the packaged bottles to be hand carried or transported.

18. A plastic bottle retaining apparatus and advertising platform (BRAAP) that includes advertising or promotional indicia applied on the BRAAP, wherein said BRAAP comprises a structure having at least one opening that is dimensioned to allow an bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure is placed on a lower surface of a package of multiple beverage bottles, with the BRAAP in contact with the lower surface of the package and one end section of said structure extending from each end of the packaged bottles, wherein the two extending end sections are gipped by a person's hands and pulled upward thereby raising said structure and the packaged bottles together, allowing the packaged bottles to be hand carried or transported wherein said at least one opening further comprises at least one slit that radially extends outward from an edge of said opening and at least one tab that extends inward from an edge of said opening, wherein the slit and tab allows panel material adjacent to said opening to flex, thereby enlarging said opening and facilitating the insertion of a bottle neck that is larger than said opening.

19. The plastic bottle retaining apparatus and advertising platform as specified in claim 15 wherein said at least one opening comprises and X-oriented opening having two perpendicular slots with four arms wherein extending outward from a first inner edge and a second inner edge of each slot arm is at least one slit, wherein when a bottle is inserted into said X-oriented opening, the combined use of said slots and said at least one slit produces a dual force retention interface on the bottle's neck, thereby securely retaining the bottle within said opening and attached to said strip.

20. A plastic bottle retaining apparatus and advertising platform (BRAAP) that includes advertising or promotional indicia applied on the BRAAP, wherein said BRAAP comprises a structure having at least one opening that is dimensioned to allow an bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure is placed on a lower surface of a package of multiple beverage bottles, with the BRAAP in contact with the lower surface of the package and one end section of said structure extending from each end of the packaged bottles, wherein the two extending end sections are gripped by a person's hands and pulled upward thereby raising said structure and the packaged bottles together, allowing the packaged bottles to be hand carried or transported further comprising two handles, with one handle located on each end of said structure, wherein said handles allow a person to grip and raise the packaged bottles.

21. A plastic bottle retaining apparatus and advertising platform (BRAAP) that includes advertising or promotional indicia applied on the BRAAP, wherein said BRAAP comprises a structure having at least one opening that is dimensioned to allow an bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure is placed on a lower surface of a package of multiple beverage bottles, with the BRAAP in contact with the lower surface of the package and one end section of said structure extending from each end of the packaged bottles, wherein the two extending end sections are gripped by a person's hands and pulled upward thereby raising said structure and the packaged bottles together, allowing the packaged bottles to be hand carried or transported wherein strip further comprises at least one cavity, located within each cavity is said advertising or promotional indicia.

22. A plastic bottle retaining apparatus and advertising platform (BRAAP) that includes advertising or promotional indicia applied on the BRAAP, wherein said BRAAP comprises a structure having at least one opening that is dimensioned to allow an bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure is placed on a lower surface of a package of multiple beverage bottles, with the BRAAP in contact with the lower surface of the package and one end section of said structure extending from each end of the packaged bottles, wherein the two extending end sections are gripped by a person's hands and pulled upward thereby raising said structure and the packaged bottles together, allowing the packaged bottles to be hand carried or transported wherein said strip further comprises at least one punch-out section, wherein located on each punch-out section is said advertising or promotional indicia.

23. A plastic bottle retaining apparatus and advertising platform (BRAAP) that includes advertising or promotional indicia applied on the BRAAP, wherein said BRAAP comprises a structure having at least one opening that is dimensioned to allow an bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled nom said opening, the bottle is released, thereby allowing the bottle to be removed from said structure, wherein said structure is placed on a lower surface of a package of multiple beverage bottles, with the BRAAP in contact with the lower surface of the package and one end section of said structure extending from each end of the packaged bottles, wherein the two extending end sections are gripped by a person's hands and pulled upward thereby raising said structure and the packaged bottles together, allowing the packaged bottles to be hand carried or transported, wherein said advertising indicia is applied by means selected from the group consisting of etching, attaching an outward extending feature, adhesion, screen printing and molding.

24. A plastic bottle retaining apparatus and advertising platform (BRAAP) that includes advertising or promotional indicia applied on the BRAAP, wherein said BRAAP comprises a structure having at least one opening that is dimensioned to allow an bottle's neck to be inserted into said opening or removed rom said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure is placed on a lower surface of a package of multiple beverage bottles, with the BRAAP in contact with the lower surface of the package and one end section of said structure extending tom each end of the packaged bottles, wherein the two extending end sections are gripped by a person's hands and pulled upward thereby raising said structure and the packaged bottles together, allowing the packaged bottles to be hand carried or transported wherein at least one punch-out section comprises at least one pull-tab that allows the punch-out section to be grasped, thereby facilitating the extraction of the pull-tab.

25. A plastic bottle retaining apparatus and advertising platform (BRAAP) that includes advertising or promotional indicia applied on the BRAAP, wherein said BRAAP comprises a structure having at least one opening that is dimensioned to allow an bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure is placed on a lower surface of a package of multiple beverage bottles, with the BRAAP in contact with the lower surface of the package and one end section of said structure extending from each end of the packaged bottles, wherein the two extending end sections are gripped by a person's hands and pulled upward thereby raising said structure and the packaged bottles together, allowing the packaged bottles to be hand carried or transported wherein the at least one punch-out section comprises at least one pull-tab that allows the punch-out section to be grasped, thereby facilitating the extraction of the pull-tab.

26. A plastic bottle retaining apparatus and advertising platform (BRAAP) that includes advertising or promotional indicia applied on the BRAAP, wherein said BRAAP comprises a structure having at least one opening that is dimensioned to allow an bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure is placed on a lower surface of a package of multiple beverage bottles, with the BRAAP in contact with the lower surface of the package and one end section of said structure extending from each end of the packaged bottles, wherein the two extending end sections are gripped by a person's hands and pulled upward thereby raising said structure and the packaged bottles together, allowing the packaged bottles to be hand carried or transported wherein said structure further comprising sequential numbers at each successive opening, wherein the numbers allow a person to immediately determine the quantity of plastic bottles that are on said structure.

27. A plastic bottle retaining apparatus and advertising platform (BRAAP) that includes advertising or promotional indicia applied on the BRAAP, wherein said BRAAP comprises a structure having at least one opening that is dimensioned to allow an bottle's neck to be inserted into said opening or removed from said opening, wherein when a bottle's neck is inserted into said opening, the bottle is retained on said structure, wherein said BRAAP with the retained bottle is stored or transported, wherein when an inserted bottle's neck is pulled from said opening, the bottle is released, thereby allowing the bottle to be removed from said structure, wherein said structure is placed on a lower surface of a package of multiple beverage bottles, with the BRAAP in contact with the lower surface of the package and one end section of said structure extending from each end of the packaged bottles, wherein the two extending end sections are gipped by a person's hands and pulled upward thereby raising said structure and the packaged bottles together, allowing the packaged bottles to be hand carried or transported wherein said structure further comprising a peripheral reinforcement that surrounds advertising cavities or punch-outs, wherein said reinforcement provides increased structural strength around said cavities or punch-outs to ensure the cavities or punch-outs do not inadvertently detach from said structure.

* * * * *